US009303349B2

(12) United States Patent
Moon et al.

(10) Patent No.: US 9,303,349 B2
(45) Date of Patent: Apr. 5, 2016

(54) CLOTHES TREATING APPARATUS AND METHOD FOR CONTROLLING THE SAME

(71) Applicants: Taechul Moon, Seoul (KR); Kayeon Kim, Seoul (KR); Ayeong Lee, Seoul (KR); Sogkie Hong, Seoul (KR); Junghwan Lee, Seoul (KR)

(72) Inventors: Taechul Moon, Seoul (KR); Kayeon Kim, Seoul (KR); Ayeong Lee, Seoul (KR); Sogkie Hong, Seoul (KR); Junghwan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 641 days.

(21) Appl. No.: 13/676,812

(22) Filed: Nov. 14, 2012

(65) Prior Publication Data

US 2013/0117944 A1 May 16, 2013

(30) Foreign Application Priority Data

Nov. 15, 2011 (KR) ..... 10-2011-0118863

(51) Int. Cl.

| | |
|---|---|
| ***D06F 33/02*** | (2006.01) |
| ***D06F 73/02*** | (2006.01) |
| ***D06F 58/10*** | (2006.01) |

(52) U.S. Cl.

CPC ..... *D06F 33/02* (2013.01); *D06F 58/10* (2013.01); *D06F 73/02* (2013.01)

(58) Field of Classification Search

CPC ..... D06F 73/02; D06F 33/02; D06F 58/10

See application file for complete search history.

(56) References Cited

U.S. PATENT DOCUMENTS

| | | | | |
|---|---|---|---|---|
| 2007/0169519 | A1 | 7/2007 | Hershey et al. | |
| 2010/0147040 | A1 * | 6/2010 | Kim et al. | 68/5 C |
| 2010/0236296 | A1 | 9/2010 | Choi et al. | |
| 2012/0017654 | A1 * | 1/2012 | Park et al. | 68/5 C |
| 2012/0240427 | A1 * | 9/2012 | Park et al. | 34/381 |
| 2012/0317729 | A1 * | 12/2012 | Song et al. | 8/137 |
| 2013/0086830 | A1 * | 4/2013 | Moon et al. | 38/1 A |

FOREIGN PATENT DOCUMENTS

| | | | |
|---|---|---|---|
| CN | 101349001 | A | 1/2009 |
| DE | 3627940 | A1 | 3/1988 |
| EP | 0122569 | A2 | 10/1984 |
| EP | 0573726 | A1 | 12/1993 |
| EP | 1 808 522 | A1 | 7/2007 |

(Continued)

*Primary Examiner* — Joseph L Perrin

(74) *Attorney, Agent, or Firm* — Dentons US LLP

(57) ABSTRACT

The present invention relates to a cloth treating apparatus and a method for controlling the same.

The cloth treating apparatus includes a main cabinet having a first housing space for housing cloth therein and a water spray unit for supplying steam to the first housing space, at least one supplementary cabinet having a second housing space for housing the cloth therein, and a control unit for controlling the water supply unit to supply the steam to the first housing space or the second housing space, selectively, wherein the main cabinet and the supplementary cabinet are installed adjacent to, or spaced from, each other.

16 Claims, 26 Drawing Sheets

(56) References Cited

FOREIGN PATENT DOCUMENTS

| | | | |
|---|---|---|---|
| JP | 03-258264 | | 11/1991 |
| JP | 03-258265 | | 11/1991 |
| JP | 2001-353399 | | 12/2001 |
| JP | 2004-057649 | | 2/2004 |
| JP | 2006-042857 | | 2/2006 |
| JP | 2009-247898 | | 10/2009 |
| KR | 10-2007-0121970 | A | 12/2007 |
| KR | 10-0830513 | B1 | 5/2008 |
| KR | 10-2009-0017826 | A | 2/2009 |
| KR | 1020090052460 | A | 5/2009 |
| KR | 10-2009-0100803 | A | 9/2009 |
| KR | 10-2011-0067833 | A | 6/2011 |
| KR | 10-2011-0099914 | A | 9/2011 |
| TW | M251852 | U | 12/2004 |
| WO | WO 2011/108860 | A2 | 9/2011 |

* cited by examiner

CLOTHES TREATING APPARATUS AND METHOD FOR CONTROLLING THE SAME

CROSS REFERENCE TO RELATED APPLICATION

Pursuant to 35 U.S.C. §119(a), This application claims the benefit of the Patent Korean Application No. 10-2011-0118863, filed on Nov. 15, 2011, which is hereby incorporated by reference as if fully set forth herein.

BACKGROUND OF THE DISCLOSURE

1. Field of the Disclosure

The present invention relates to a cloth treating apparatus and a method for controlling the same, and more particularly, to a cloth treating apparatus which can make independent cloth treatment for respective housing spaces of a plurality of cabinets, and a method for controlling the same.

2. Discussion of the Related Art

In general, the cloth treating apparatus includes a washing machine for washing laundry, a dryer for drying the laundry, and a drying and washing machine for washing and drying the laundry. And, in the dryer, there may be a drum type dryer and a cabinet type dryer depending on a space which houses the cloth. The drum type dryer is of a type the space which houses the cloth, i.e., the drum, rotates, and the cabinet type dryer is of a type the space which houses the cloth does not move. The Korea Patent Application No. 10-2007-0018389 discloses the cabinet type dryer, titled "DRYER AND METHOD FOR CONTROLLING THE DRYER".

A related art dryer will be described with reference to FIG. 34. The dryer is provided with a cabinet for housing a drying object, a low temperature air producing unit (Not shown) for producing a relatively low temperature air to be supplied to the cabinet for drying the drying object, and a flow passage (Not shown) for supplying the relative low temperature air from the low temperature air producing unit to the cabinet. And, different from the drum type dryer, the cloth is housed in the cabinet in a secured state. It is preferable that a supporting element 5 is provided in the cabinet for hanging the cloth therefrom.

In the meantime, the related art cloth treating apparatus has only one space for housing the cloth therein. Therefore, it is impossible to perform different modes of treatment for different kinds of cloths at the same time.

SUMMARY OF THE DISCLOSURE

The cloth treating apparatus of the present invention provides a plurality of housing spaces for housing a plurality of cloths individually to treat the cloths proper to characteristics of individual cloths; and a method for controlling the same.

And, the cloth treating apparatus of the present invention provides means for removing wrinkles, and/or odors from the cloth. Particularly, the cloth treating apparatus of the present invention provides means for providing high temperature steam to a contaminated portion of a cloth intensively for removing the contamination if the cloth is contaminated locally.

And, the cloth treating apparatus of the present invention can reduce time period required for treating cloths on the whole by controlling a plurality of housing spaces with a control unit, and giving different modes of priorities to the housing spaces.

And, the cloth treating apparatus of the present invention can enhance space utilization by forming a plurality of individual housing spaces in various shapes to enable to place various elements, such as accessories, in the spaces formed thus.

The cloth treating apparatus of the present invention can prevent a user from exposing to hazards by turning off spray of water or steam to the user if a door to the space is opened.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cloth treating apparatus includes a main cabinet having a first housing space for housing cloth therein and a water spray unit for supplying steam to the first housing space, at least one supplementary cabinet having a second housing space for housing the cloth therein, and a control unit for controlling the water supply unit to supply the steam to the first housing space or the second housing space selectively, wherein the main cabinet and the supplementary cabinet are installed adjacent to, or spaced from, each other.

Particularly, it is preferable that the control unit is provided to the main cabinet.

In the meantime, the control unit may determines cloth treatment priorities of the main cabinet and the supplementary cabinet according to steam rates of the first housing space or the second housing space required.

The control unit may treat the cloth in the cabinet which requires the steam rate higher than the other cabinet, at first. Opposite to this, the control unit may treat the cloth in the cabinet which requires the steam rate lower than the other cabinet, at first.

Of course, the main cabinet may have an air supply unit provided thereto for supplying air or heated air to the first housing space, and the control unit may control the air supply unit to supply the air or the heated air both to the first housing space and the second housing space or either to the first housing space or to the second housing space.

And, the air supply unit may include a heat pump having an evaporator, a compressor, and a condenser for circulating refrigerant therethrough.

And, the cloth treating apparatus may further include a movable hanger for hanging the cloth therefrom and applying a predetermined movement to the cloth.

Two sets of the supplementary cabinet may be provided, and the supplementary cabinets are arranged side by side on one side of the main cabinet.

Opposite to this, two sets of the supplementary cabinet may be provided, and the supplementary cabinets may be arranged on both sides of the main cabinet.

The main cabinet may have a display unit provided thereto for displaying information on the cloth treatment made at the first housing space and the second housing space.

In the meantime, the main cabinet may include a main communication unit for communication with the control unit, and the supplementary cabinet may include a supplementary communication unit for communication with the main communication unit.

In another aspect of the present invention, a method for controlling a cloth treating apparatus, including a main cabinet having a first housing space for housing cloth therein and a water spray unit for supplying steam to the first housing space, at least one supplementary cabinet having a second housing space for housing the cloth therein, and a control unit for controlling the water supply unit to supply the steam to the first housing space or the second housing space selectively, includes a measuring step for measuring a steam rate to be used for the first housing space, and the steam rate to be used for the second housing space, a determining step for setting priorities of cloth treatment according to a result of the measurement in the measuring step, and a cloth treating step for performing cloth treatment of the cloth with a first priority.

And, the determining step may include the step of giving the first priority to the cloth in the cabinet which requires a higher steam rate than other cabinets.

In this case, the determining step may include the step of giving the first priority to the cloth in the cabinet which requires a lower steam rate than other cabinets.

The cloth treating step may include the step of supplying air or heated air both to the first housing space and the second housing space or either to the first housing space or to the second housing space.

In another aspect of the present invention, a method for controlling a cloth treating apparatus, including a main cabinet having a first housing space for housing cloth therein and a water spray unit for supplying steam to the first housing space, at least one supplementary cabinet having a second housing space for housing the cloth therein, and a control unit for controlling the water supply unit to supply the steam to the first housing space or the second housing space selectively, includes an input order determining step for determining an input order of commands inputted by a user to be performed for the first housing space and the second housing space, and a cloth treating step for treating the cloth for the first housing space or the second housing space according to the user's input order.

Advantageous Effects of the Present Invention

The cloth treating apparatus of the present invention permits to store various cloths in spaces spaced from one another individually and to treat the cloths meeting characteristics of each of the cloths.

And, by mounting elements like the control unit only to the main cabinet, a large space can be secured to the supplementary cabinet for housing the cloth. That is, the cloth treating apparatus of the present invention permits to mount elements both the main cabinet and the supplementary cabinet require commonly only to the main cabinet for controlling a plurality of the supplementary cabinet from the main cabinet.

And, the cloth treating apparatus of the present invention permits to save a time period required for treating cloths on the whole by providing different algorithms which enable to treat the various cloths at the same time or independently.

Particularly, by driving the air supply unit or the water supply unit according to a time period, effective use of entire resources used for the cloth treating apparatus is made available.

And, if some doors of the plurality of cabinets are opened, the water or steam spray to the cabinets having the doors opened thus is turned off for enhancing safety of the user.

As described before, the present invention is characterized in that the supply unit which supplies the steam is not secured to an inside of the cloth treating apparatus, but is movable freely in a state the steam is being supplied in a case relatively high temperature steam is supplied. Therefore, if the cloth is contaminated at a local portion, such as an elbow thereof, the high temperature steam may be supplied only to the local portion which is contaminated, such as the elbow intensively by moving the supply unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
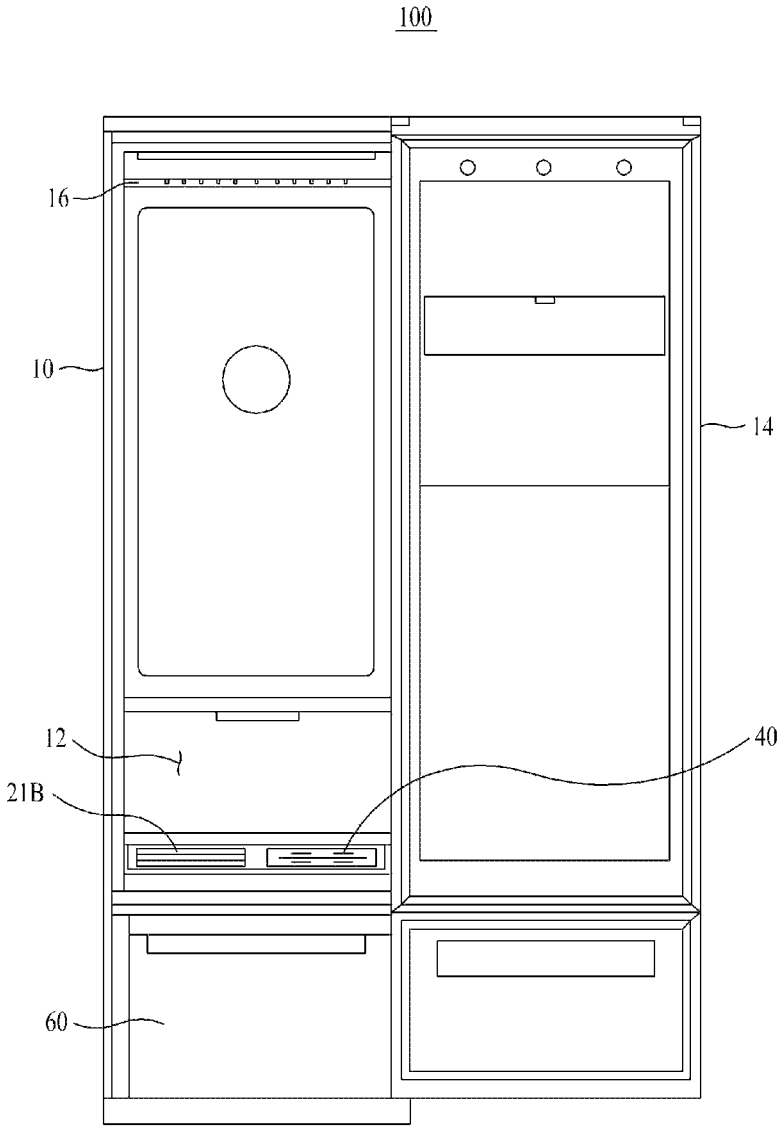
FIG. 1 illustrates a front view of a main cabinet in a cloth treating apparatus in accordance with a preferred embodiment of the present invention.

FIG. 1 illustrates a front view of a main cabinet of a cloth treating apparatus in accordance with a preferred embodiment of the present invention, with a door 14 opened state.

Though the present invention describes a refresher which supplies heated air to cloth for refreshing the cloth, the present invention is not limited to this, but is applicable to other devices which are provided with heat pumps. The refresh may mean a process for providing air, heated air, water, mist and steam toward the cloth for removing wrinkles from the cloth, deodorizing the cloth, sanitizing the cloth, preventing static electricity, or warming the cloth. Moreover, the cloth mentioned in the specification includes, not only objects a person may wear, such as clothes, and apparel, but also shoes, socks, gloves, a headgear, and a muffler, but also objects a person may use, such as a doll, a handkerchief, and blanket, i.e., all objects which require washing.

Referring to FIG. 1, the main cabinet 100 of the cloth treating apparatus includes a cabinet 10 which forms a first housing space 12 for housing cloth therein. The cabinet 10 houses the cloth and forms an exterior appearance of the cloth treating apparatus. The main cabinet 100 includes a water supply unit 30 (See FIG. 5) for spraying water, mist, or steam (Hereafter will be called as 'steam', collectively) to the first housing space 12. And, the main cabinet 100 of the cloth treating apparatus may also include an air supply unit 22 (See FIG. 5) for supplying air or heated air to the first housing space 12. And, the main cabinet 100 of the cloth treating apparatus may also include a control unit (Not shown) for controlling the water supply unit 30 and the air supply unit 22.

The cabinet 19 has various elements which will be described later provided thereto, and the first housing space 12 provided therein. The first housing space 12 is in communication with an outside of the cabinet 10 by a door 14 selectively. Moreover, the first housing space 12 has various kinds of supporters 16 provided thereto for hanging the cloth therefrom. The supporter 16 may be provided such that the cloth maintains a stationary state, or a secured state, without movement. In the meantime, as described later, the supporter may be configured to apply a predetermined movement to the cloth if the air, the heated air, or the steam is supplied to the cloth, which will be described with reference to FIGS. 2 and 3.

Figure 2:
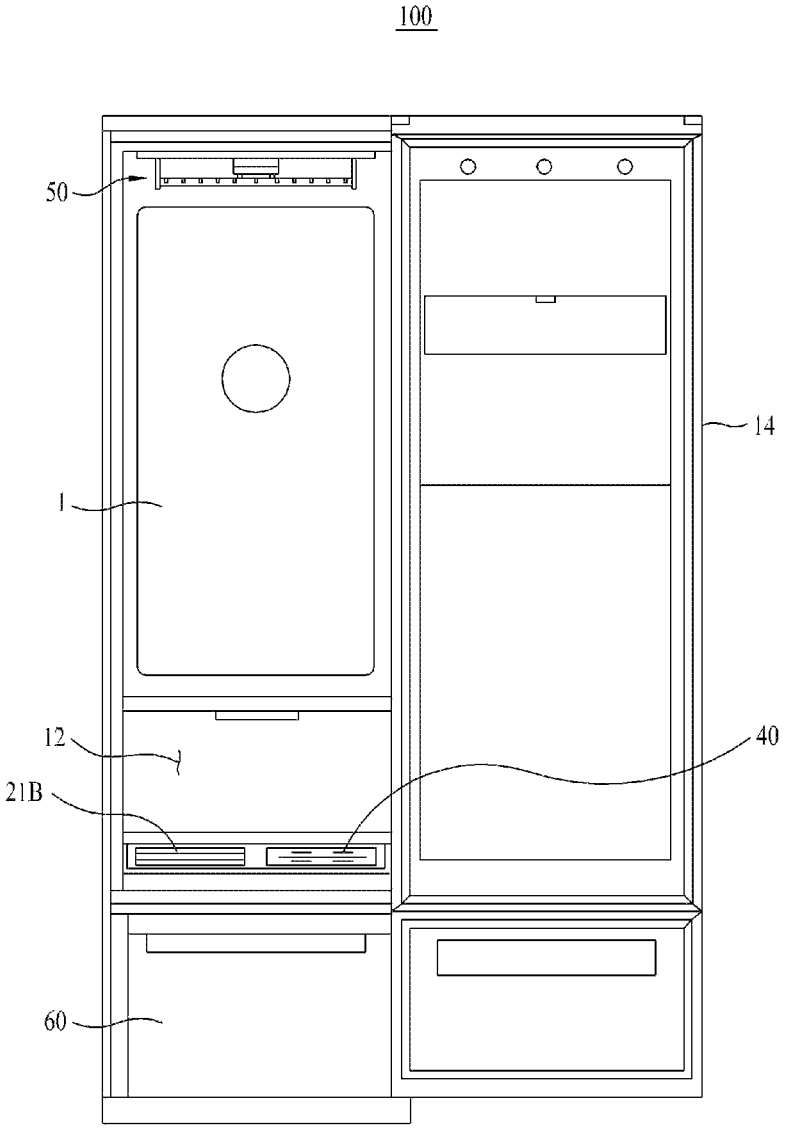
FIG. 2 illustrates a front view of a main cabinet in a cloth treating apparatus in accordance with another preferred embodiment of the present invention.

FIG. 2 illustrates a front view of a cloth treating apparatus in accordance with another preferred embodiment of the present invention. In comparison to the first embodiment, the cloth treating apparatus of another preferred embodiment is different in that the cloth treating apparatus of another preferred embodiment includes a movable hanger. The cloth treating apparatus of another preferred embodiment of the present invention will be described focused on the difference.

Referring to FIG. 2, there is the movable hanger 50 provided in the first housing space 12 for hanging the cloth therefrom. The movable hanger 50 is configured to apply predetermined movement to the cloth. If the predetermined movement is applied to the cloth in a case the air, the heated air, or the steam is supplied to the cloth, a refresh effect of the cloth will be enhanced.

Figure 3:
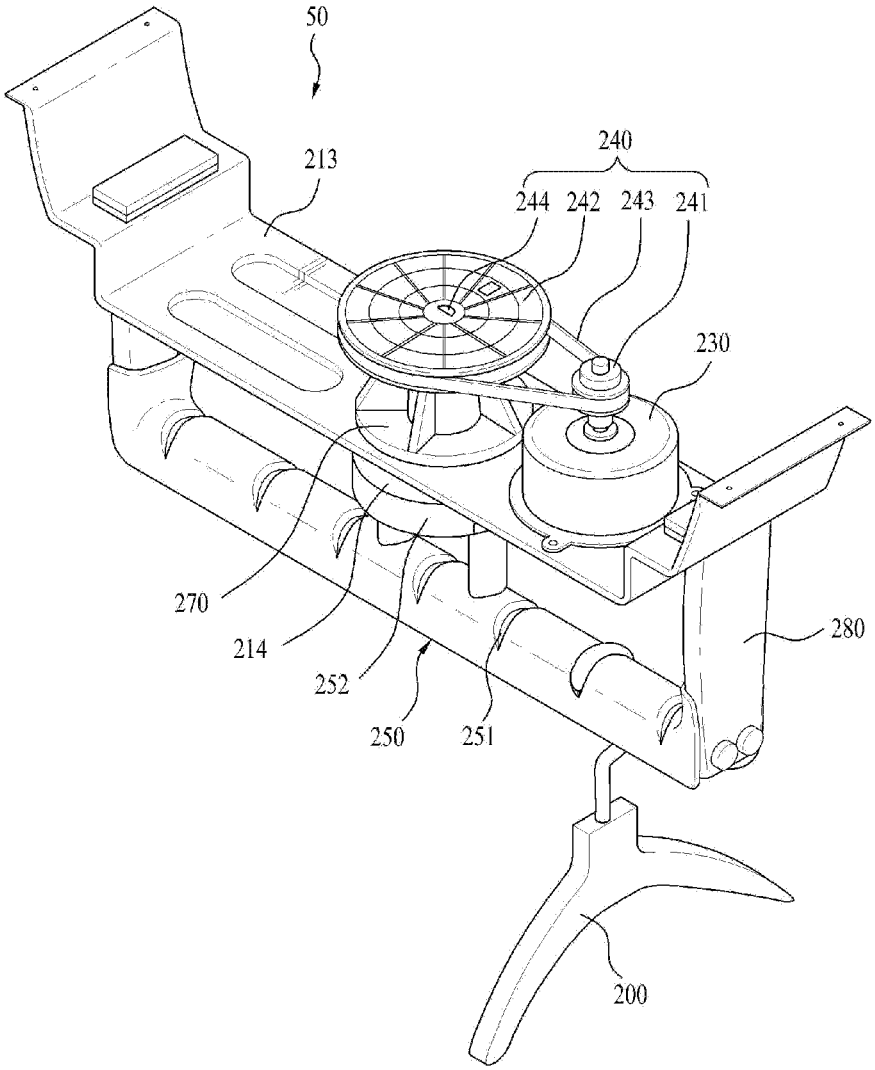
FIG. 3 illustrates a perspective view of a movable hanger in the cloth treating apparatus in FIG. 2.
Figure 4:
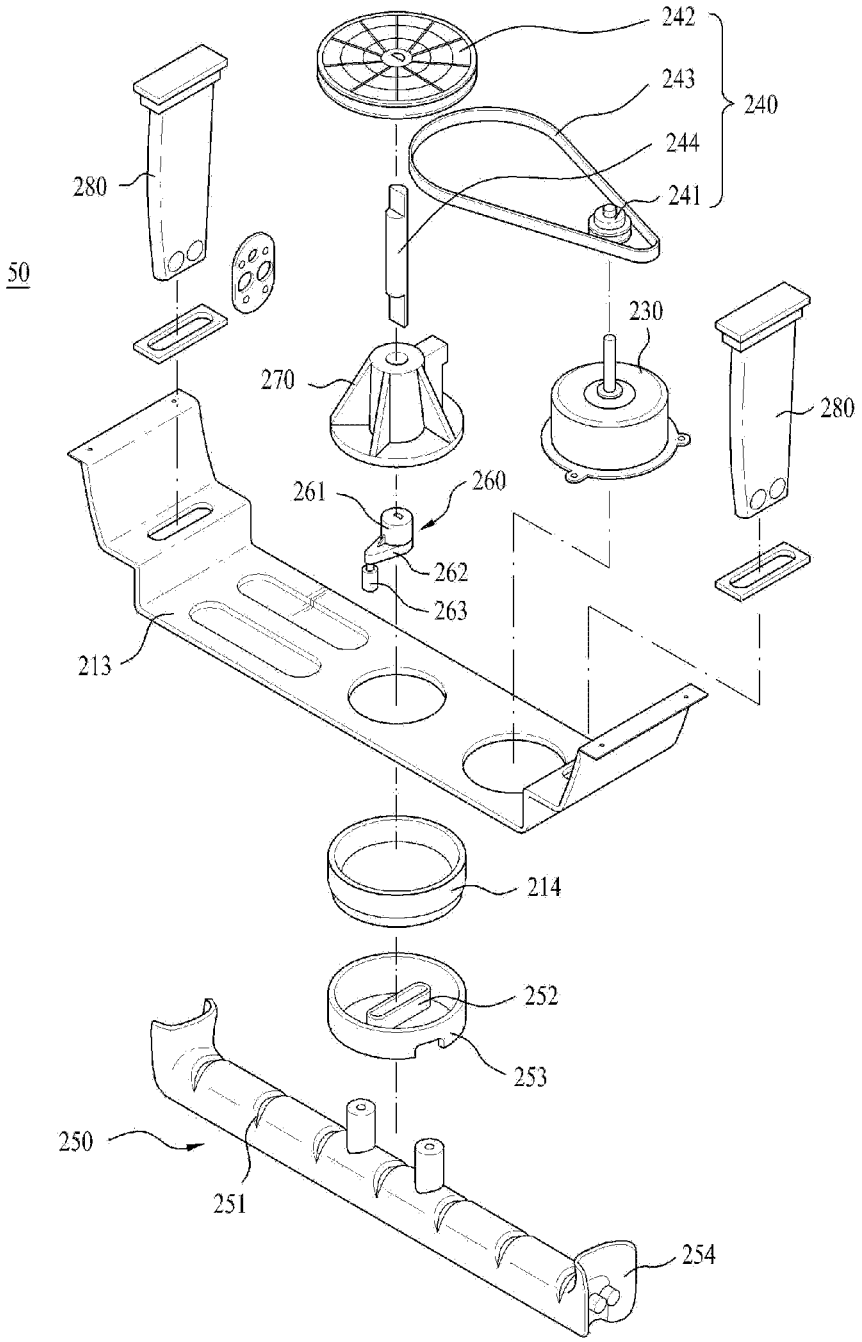
FIG. 4 illustrates an exploded perspective view of FIG. 3.

FIG. 3 illustrates a perspective view of a movable hanger 50, and FIG. 4 illustrates an exploded perspective view of the movable hanger 50.

Referring to FIGS. 3 and 4, the movable hanger 50 includes a hanger bar 250 for supporting a cloth hanger 200 having the cloth hung therefrom, and a supporter 280 for supporting both ends of the hanger bar 250. The hanger bar 250 has a plurality of cloth hanger grooves 251 provided therein for positioning the cloth hanger 200 when the cloth hanger 200 is placed thereon. The supporter 280 is connected to, and supported by, a movable hanger frame 213 provided to an upper side of an inside of ceiling of the cabinet 10 to be invisible from an outside of the cabinet 10. The hanger bar 250 has both ends provided with supporter ribs 254 to surround, and to be connected to, the supporter 280, respectively.

Therefore, since the cloth treating apparatus of the embodiment has the cloth placed therein hung from the cloth hanger, the cloth treating apparatus has effects much better than the related art cloth treating apparatus, not only in refreshing, but also in drying efficiency of the cloth.

In the meantime, the movable hanger 50 includes a motor 230, a power converter 260 for converting rotating movement from the motor 230 to a horizontal linear movement of the hanger bar 250, and a power transmitter 240 for transmission of the power from the motor 230 to the power converter 260.

The power transmitter 240 may include a driving pulley 241 provided to the motor 230, a driven pulley 242 connected to the driving pulley 241 with a belt 243, and a rotating shaft 244 coupled to a center of the driven pulley 242. The rotating shaft 244 is rotatably mounted in a bearing housing 270 provided to the movable hanger frame 213.

It is preferable that the hanger bar 250 further includes a slot 252 perpendicular to a length direction of the hanger bar 250. In detail, the hanger bar 250 has a slot housing 254 over the hanger bar 250, with the slot 252 provided in the slot housing 253 at a center thereof, substantially. And, the power converter 260 may include a slot pin 263 placed in the slot 252, a shaft coupler 261 coupled to the rotating shaft 244, and a rotatable arm 262 connected between the slot pin 263 and the shaft coupler 261. The power converter 260 is covered with a cover 214 to make the power converter 260 invisible from an outside of the movable hanger 50 provided between the movable hanger frame 213 and the slot housing 253.

In above configuration, if the motor 230 rotates, the driven pulley 242 rotates to rotates the rotating shaft 244 coupled to the driven pulley 242 too, such that the slot pin 263 makes a circular motion with a predetermined diameter.

In the meantime, the slot 252 is provided to the hanger bar 250 perpendicular to a length direction of the hanger bar 250, with a length thereof longer than a rotating locus of the slot pin 263. Therefore, even if the slot pin 263 makes the circular motion, the slot 252 makes a horizontal linear motion. According to this, the hanger bar 250 coupled to the slot 250 makes the horizontal linear motion, too.

In the meantime, a machinery room 20 is provided to in the cabinet 10, which houses the air supply unit 22 and the water supply unit 30. Preferably, the machinery room 20 is positioned under the first housing space 12, and has the air supply unit 22 and the steam generating unit 32 of the water supply unit 30 provided therein. The machinery room 20 is positioned under the first housing space 12 thus because it is preferable that the machinery room 20 positioned under the first housing space 12 supplies the heated air and the steam upward by using a rising nature of the heated air and the steam being supplied to the first housing space 12.

Figure 5:
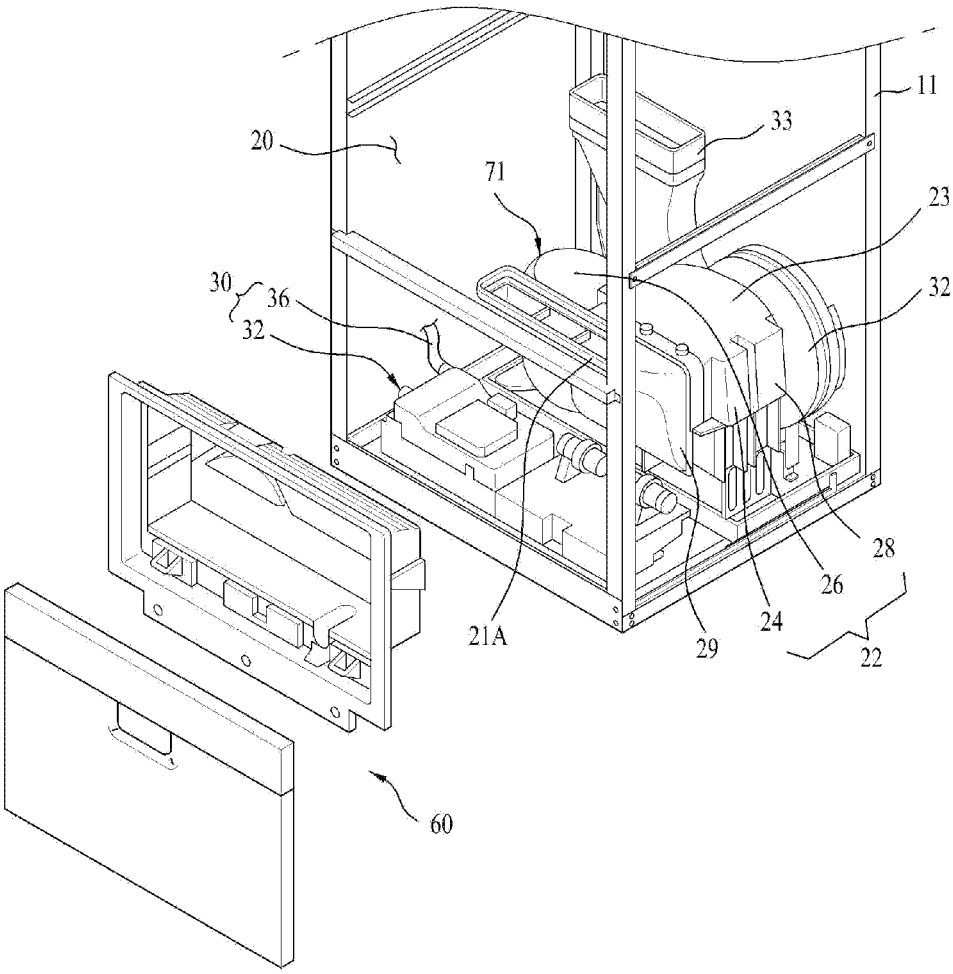
FIG. 5 illustrates a perspective view of an inside of a machinery room of a main cabinet in a cloth treating apparatus in accordance with a preferred embodiment of the present invention.

FIG. 5 illustrates a perspective view of an inside of the machinery room 20, schematically. In order to show the inside of the machinery room 20, FIG. 5 illustrates a frame 11 which is a skeleton of the cabinet 10 only, for convenience of view. And, for convenience of description, FIG. 5 illustrates major elements, including the air supply unit 22 and the water supply unit 30, but not pipelines which connect the major elements.

Referring to FIG. 5, the machinery room 20 has the water supply unit 30 provided thereto for supplying the steam to the first housing space 12, selectively.

The water supply unit 30 may include the steam generating unit 32 for heating the water to generate the steam, a water supply line 36 for guiding the steam from the steam generating unit 32 to the first housing space 12. Moreover, the water supply unit 30 may further include a water supply nozzle 40 at an end of the water supply line 36 for supplying the steam.

The steam generating unit 32 has a heater (Not shown) provided therein for heating the water to produce the steam to be supplied to the first housing space 12. As a water supply source for supplying the water to the steam generating unit 32, an external water faucet may be used or a water supply tank (Not shown) provided to one side of the machinery room 20 may be used.

Preferably, the water supply tank may be provided to a door module detachably mounted to one side of the machinery room 20, and the water supply tank may be detachably provided to the door module 60. Accordingly, the user can detach the water supply tank from the machinery room 20, fills the water supply tank with the water, and mounts the water supply tank to the machinery room 20, again.

The steam produced from the steam generating unit 32 is supplied to the first housing space 12 through the water supply line 36. If the water supply nozzle 40 is provided, the steam may be supplied to the first housing space 12 to have a direction by using the water supply nozzle 40. In this case, in order to prevent a temperature of the steam from dropping or the steam from condensing during the steam flows along the water supply line 36, it is favorable that the water supply line 36 is the shorter. Accordingly, if the machinery room 20 is positioned under the first housing space 12, it is preferable that the water supply nozzle 40 supplies the steam through an upper side of the machinery room 20, i.e., an underside of the first housing space 12.

And, the machinery room 20 may have a circulating fan (Not shown) provided to a rear thereof. The circulating fan supplies the air to the machinery room 20 from an outside of the machinery room 20 for preventing a temperature of an inside of the machinery room 20 from rising excessively due to operation of the heat pump 22 and the water supply unit 30.

In the meantime, in the machinery room 20, there is the air supply unit 22 for supplying air or the heated air to the first housing space 12.

In the cloth treating apparatus in accordance with a preferred embodiment of the present invention, a heat pump serves as the air supply unit. That is, the heat pump 22 has an evaporator 24, a compressor 26, a condenser 28, and an expansion valve (Not shown) for dehumidifying and heating the air.

That is, as the refrigerant vaporizes at the evaporator 24, the refrigerant absorbs latent heat from surrounding air to cool down the air to condense moisture in the air, thereby removing the moisture from the air. And, if the refrigerant from the compressor 26 is introduced to, and condensed at, the condenser 28, the refrigerant discharges the latent heat to surrounding air to heat the surrounding air. According to this, since the evaporator 24 and the condenser 28 function as heat exchangers, the air introduced to the machinery room 20 has moisture thereof removed, or is heated, and supplied to the first housing space 12.

Though the air heated by the heat pump 22 may have a temperature more or less lower than the air heated by a related art electric heater, the heat pump 22 can remove the moisture from the air without using a dehumidifier, additionally. Therefore, the air supplied to the first housing space 12 by the heat pump 22 is 'low temperature air' relatively (In this case, the 'low temperature' means, not an absolutely low temperature, but a relatively low temperature compared to a related art heated air, though the air is heated air). The cloth treating apparatus in accordance with a preferred embodiment of the present invention can prevent the cloth from distorting or damaging by a high temperature if cloth refreshing or drying is performed by supplying the low temperature air. In conclusion, though the air supplied by the heat pump 22 has a temperature lower than the heated air of the related art cloth treating apparatus, since the cloth treating apparatus in accordance with a preferred embodiment of the present invention supplies the air having the moisture removed therefrom without the dehumidifier, easy drying or refreshing of the cloth is possible.

In detail, the machinery room 20 has an air inlet 21A (See FIG. 5) formed in an upper side of a front thereof for introducing the air from the first housing space 12 thereto, and an introduction duct 29, connecting the air inlet 21A to the evaporator 24, the condenser 28, and the fan 22, forms a flow passage for flowing the air. The air introduced to the machinery room 20 through the introduction duct 29 and the air inlet 21A has the moisture removed therefrom and heated as the air passes through the heat pump 22, and is supplied to the first housing space 12 through a discharge duct 33 and an air outlet 21B by the fan 32, again. In the meantime, the evaporator 24 and the condenser 28 which serve as heat exchangers in the heat pump 22 may be provided to an inside of the housing 23, and the housing 23 may be connected to the introduction duct 29 and the discharge duct 33 to form one air flow duct. Therefore, the air introduced through the air inlet 21A may circulate through the introduction duct 29, the discharged duct 33, and may be supplied to the first housing space 12.

Though not shown, preferably, the air inlet 21A may have a filter provided thereto. By providing the filter to the air inlet 21A, various foreign matters may be filtered from the air introduced to the machinery room 20 from the first housing space 12, to enable to supply only fresh air to the first housing space 12.

In the meantime, in the main cabinet 100 of the cloth treating apparatus, the water supply unit 30 supplies the steam to the first housing space 12, and the water supply unit 30 has the water supply line 36 or the water supply nozzle 40. In this case, the water supply line 36 and/or the water supply nozzle 40 is mounted to one side of the first housing space 12 for supplying the steam to the first housing space 12. That is, the water supply line 36 has one end connected to the steam generating unit 32, and the other end connected to the first housing space 12, and, if the water supply line 36 is provided with the water supply nozzle 40, the water supply nozzle 40 is provided to an end of the water supply line 36 and mounted to one side of the first housing space 12. In the meantime, if the water supply nozzle 40 is mounted to one side of the first housing space 12, the steam can be supplied only at the mounted position, and is difficult to move the water supply nozzle 40 in a state the steam is being supplied. Such positional restriction of the steam supply acts as a factor that limits utilization of the main cabinet 100 of the cloth treating apparatus.

That is, there may be necessity for supplying the steam, not only in a case the cloth is housed in the first housing space 12, but also in a case the cloth is positioned on an outside of the first housing space 12, i.e., the cloth is spaced a predetermined distance from the first housing space 12 or the cabinet 10. Moreover, there may be a case in which, since the user has no adequate time period for driving a predetermined course of the cloth treating apparatus, the user may be necessary to remove wrinkles, smells and so on from the cloth by supplying the steam for a moment before putting on the cloth. Especially, if contaminant is stuck to the cloth locally, i.e., a portion of the cloth, such as an elbow or the like, supplying the steam only to the contaminated portion intensively is effective for removing the contaminant, rather than supplying the steam throughout the cloth.

In above case, not a configuration fixed to one side of the first housing space 12 for supplying the steam, but a configuration movable freely in a state the steam is being supplied is required. This will be discussed with reference to the drawings, in detail.

Figure 6:
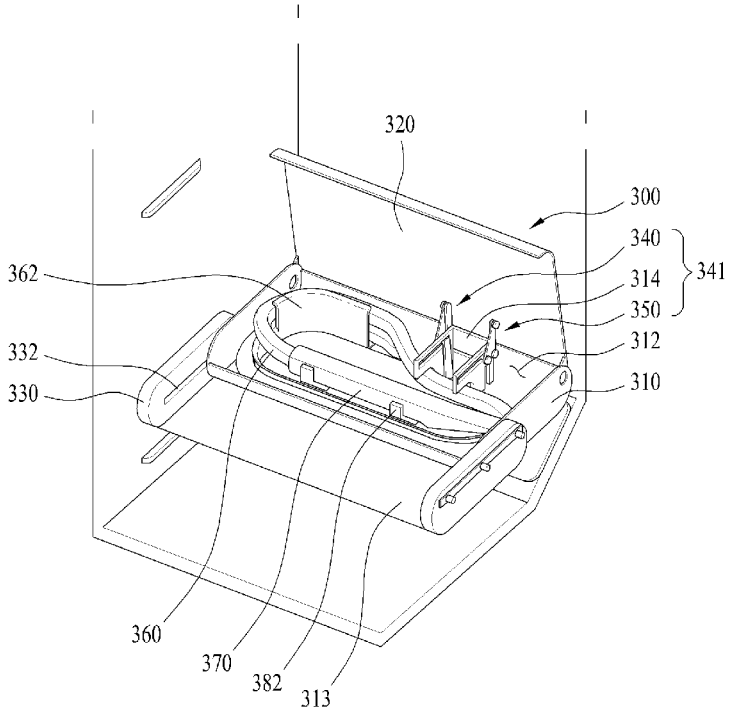
FIG. 6 illustrates a perspective view of a water spray unit in a cloth treating apparatus.

FIG. 6 illustrates a perspective view of a water spray unit 300 in a cloth treating apparatus. The inventor makes it clear that FIG. 6 illustrates only the water spray unit provided in the first housing space 12.

Referring to FIG. 6, the water spray unit 300 is provided to one side of the cabinet 10 to be movable a predetermined distance, to enable to connect the same to the water supply unit 30, selectively. That is, if the steam supply is adequate only with the water supply unit 30, the water spray unit 300 is not connected to the water supply unit 30, and, for an example, if it is necessary to supply the steam to a portion of the cloth intensively, the water spray unit 300 is coupled to the water supply unit 30.

In detail, the water spray unit 300 is provided to one side of the first housing space 12 to be movable a predetermined distance, to enable to connect the same to the water supply unit 30, selectively. For this, the water spray unit 300 may be provided with a housing 310 provided to one side of the first housing space 12 to be movable a predetermined distance. The housing 310 has an opened upper side to provide a housing space 312 therein. The opened upper side may be opened/closed by a cover 320. And, the housing space 312 may house a water supply gun 370 and/or a water supply hose to be described later, therein.

The housing 310 may be provided to be movable within the first housing space 12 between a first position at which the housing 310 does not couple to the water supply unit 30, and a second position at which the housing 310 couples to the water supply unit 30 to have the steam supplied thereto. As shown in FIG. 6, the housing 310 may be provided to be movable adjacent to a base of the first housing space 12. This is for securing a space for placing the cloth in the first housing space 12, and moreover, for making easy connection to the water supply nozzle 40 provided to the base of the first housing space 12.

In the meantime, the first housing space 12 may have a guide portion for guiding movement of the housing 310 for movement of the housing 310. As shown in FIG. 6, the guide portion may have one pair of guide rails 330 provided to opposite inside walls which form the first housing space 12. The guide rails 330 may be fixedly secured to the inside walls adjacent to the base of the first housing space 12 respectively, and may have grooves for guiding movement of the housing 310. And, the housing 310 may have projections (Not shown) placed in the grooves 332 in the guide rails, respectively. Therefore, the housing 310 is provided to be movable within a locus the projections are movable along the grooves 330 in the guide rails 330. Moreover, the guide portion may further provided with a base portion 313 for supporting the housing 310. The base portion 313 is provided to an underside of the housing 310 to guide the movement of the housing 310 while supporting the housing 310. For this, as shown, the base portion 313 may have both ends connected to the inside walls of the cabinet 10, preferably to the guide rails 330 described before.

A state the housing 310 does not move along the guide rails 330 is a state the housing 310 is positioned at the first position where the housing 310 does not couple to the water supply unit 30 (See FIG. 11), and, as shown in FIG. 6, if the housing 310 moves to a rear side along the guide rails 330, the housing 310 is positioned at the second position to position the housing 310 over the water supply nozzle 40 of the water supply unit 30, enabling the housing 310 to be connected to the water supply unit 30.

In the meantime, the water spray unit 300 may have a coupling unit 380 (See FIG. 7) provided in the housing 310 for selective connection to the water supply unit 30. The coupling unit 380 is provided on a lower side of the housing 310, so as to be connected to the water supply nozzle 40 for having the steam supplied thereto if the end of the water supply line 36 in the water supply unit 30 or the water supply nozzle 40 is ready to be connected thereto.

That is, the steam supplied to the coupling unit 380 through the water supply nozzle 40 as the coupling unit 380 is connected to the end of the water supply nozzle 40 is supplied to the water supply gun 370 to be described later through the coupling unit 380. The coupling unit 380 may be provided in a form of enclosing the water supply nozzle 40 such that the coupling unit 380 is able to receive the steam being supplied from the water supply nozzle 40. For an example, the coupling unit 380 may be provided to enclose a front of the water supply nozzle 40, through which the steam is supplied.

In the meantime, the coupling unit 380 may be connected to the water supply unit 30 as the housing 310 moves and/or acts. That is, in order to couple the coupling unit 380 to the water supply unit 30, the user moves, not the coupling unit 380 itself, but other element, for an example, the housing 310 which acts or moves to make the coupling unit 380 to couple to the water supply unit 30. Thus, if the coupling unit 380 couples to the water supply unit 30 interlocked to the action of the housing 310, the user can connect the coupling unit 380 to the water supply unit 30 conveniently by manipulating the housing 310 without necessity for moving the elements including the coupling unit, one by one.

In the embodiment, the coupling unit 380 can be coupled to the water supply unit 30 by two stages of movement and action of the housing 310. That is, if the housing 310 moves to the second position, the coupling unit 380 is positioned over the water supply nozzle 40 such that the coupling unit 380 can be connected to the water supply nozzle 40 (First movement and action). Then, if the user opens the cover 320 of the housing 310 (Second movement and action), the coupling unit 380 is connected to the water supply unit 30 interlocked with opening of the cover 320. Therefore, the water spray unit 300 may have a connection unit 341 which couples the coupling unit 380 to the water supply unit 30, specifically, to the water supply nozzle 40 interlocked with opening of the cover 320.

Referring to FIG. 6, the connection unit 341 may include a plurality of links. That is, the connection unit 341 connects the cover 320 to the coupling unit 380, to couple the coupling unit 380 to the water supply nozzle 40 by an opening action of the cover 320, and to decouple the coupling unit 380 from the water supply nozzle 40 by a closing action of the cover 320. The connection unit 341 has a first link unit 340 and a second link unit 350 symmetric to each other. A structure of the link unit will be described in detail, with reference to the drawings.

Figure 7:
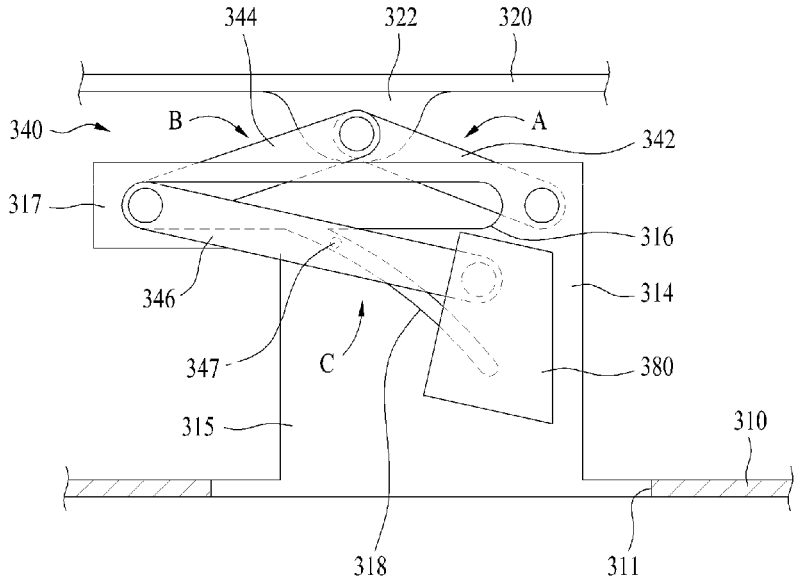
FIGS. 7 and 8 illustrate side views of the connection unit in FIG. 6, respectively.
Figure 8:
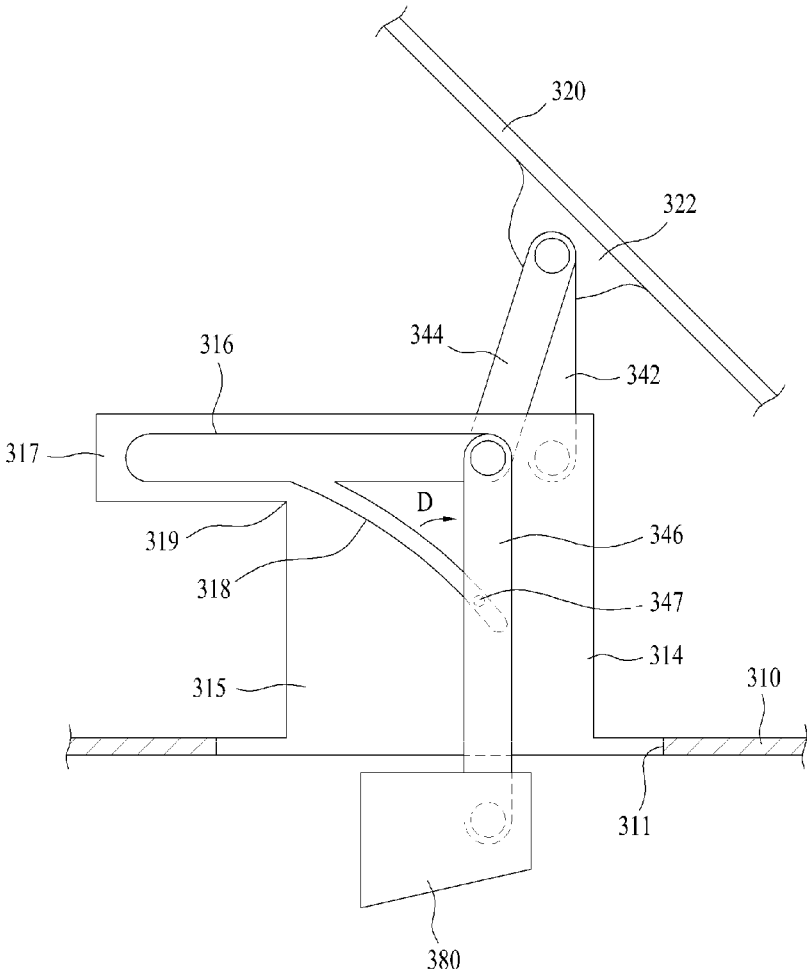

FIG. 7 illustrates the first link unit 340 and the frame 314 when the cover 320 is closed, and FIG. 8 illustrates the first link unit 340 and the frame 314 when the cover 320 is opened. The first link unit 340 will be described in detail, while omitting description of the second link unit 350 which is similar to the first link unit in configuration.

In detail, the housing 310 may have a frame 314 connected to the first link unit 340 and the second link unit 350 described before. The frame 314 is provided to an inside of the housing 310. The frame 314 may be formed as one unit with the housing 310. The embodiment suggests providing the frame 314 on a bottom of the housing 310. The frame may include a post 315 projected upward from the bottom of the housing 310, and an extension 317 provided to one end of the post 315. The extension 317 may be perpendicular to the post, and may have a first opening 316 to be described later formed therein. A connection part between the post 315 and the extension 317 has a recess 319 receiving the water supply hose 360. Namely, the water supply hose 360 is received between a bottom surface of the extension 317 and one side of the post 315.

The first link unit 340 includes a first link 342 rotatably connected to the cover 320 and the frame 314, respectively. The first link 342 has one end rotatably connected to the cover 320, and the other end rotatably connected to one side of the frame 314. The first link unit 340 may further include a second link 344 connected to the cover 320 and the frame 314. The second link 344 has one end rotatably connected to a rotation connection 322 at the cover 320, and the other end provided movable along the first opening 316 in the frame 314. The first opening 316 may be a rectangular slot. As the cover 320 is opening and closing, the other end of the second link 344 moves along the second opening 318 in the frame 314. The first link unit 340 may also include a third link 346 connected to the frame 314 and the coupling unit 380, respectively. In this case, the third link 346 has one end provided to be movable along the first opening in the frame 314, and the other end connected to the coupling unit 380. Moreover, the third link 346 and the second link 344 are connected to each other through the first opening 316 in the frame 314. At the end, the opening and closing of the cover 320 makes the other end of the second link unit 344 and one end of the third link 346 to move along the first opening 316. An action of the first link unit 340 which is interlocked with an action of the cover 320 will be described.

Referring to FIG. 7, if the cover 320 is in a closed state, the first link 342 and the second link 344 are positioned opposite to each other with respect to the rotation connection 322. That is, since the other end of the first link 342 is connected in a rotatable but immovable state, the first link 342 rotates toward the first opening 316 along an arrow mark A as the cover 320 is closed. And, since the second link 344 rotates in an arrow direction B as the cover 320 is closed, the other end of the second link 344 moves along the first opening 316 in the frame 314. At the end, the first link 342 and the second link 344 are put in a state in which the first link 342 and the second link 344 are unfolded in opposite directions.

In the meantime, since one end of the third link 346 is connected to the other end of the second link 344, the one end of the third link 346 also moves along the first opening 316. In this case, since the one end of the third link 346 and the other end of the second link 344 are rotatably connected to each other, if there is no other element, the other end (The end the coupling unit 380 is coupled thereto) of the third link 346 maintains a hang down state perpendicular to the first opening 316. If the third link 346 maintains such a state, the coupling unit 380 connected to the other end of the third link 346 is not housed in the housing 310, but positioned on an outside of the housing 310, not only resulting in a poor appearance, but also occupying a large space. Therefore, the frame 314 may further include the second opening 318 for guiding movement of the third link 346, and the third link 346 may have a projection 347 matched to the second opening 318. Though the drawing shows that the second opening 318 is configured to be in communication with the first opening 316, the configuration is not limited to this, but, for an example, it is also possible that the first opening 316 and the second opening 318 may not be in communication with each other in the frame 314, but the first opening 316 and the second opening 318 are provided, individually. As shown in FIG. 7, if the cover 320 is closed, since the projection 347 moves along the second opening 318, the third link 346 moves along an arrow mark C, making the coupling unit 380 to be housed in the housing 310.

In the meantime, FIG. 8 illustrates a cover 320 opened state.

Referring to FIG. 8, since the first link 342 has both ends connected to the cover 320 and the frame 314, if the cover 320 is opened, one end of the first link 342 rotates upward from the frame 314. In the meantime, since the second link 344 also has one end connected to the cover 320, the one end of the second link 344 moves upward and the other end of the second link 344 moves along the first opening 316. At the end, the second link 344 moves to an upper side of the frame 314 perpendicular to the first link 316, substantially.

And, the one end of the third link 346 moves along the first opening 316 interlocked with movement of the second link 344. And, if the third link 346 moves, since the projection 347 moves along the second opening 318, at the end, the third link 346 rotates in an arrow mark D direction toward a lower side of the frame 314 perpendicular to the first opening 316, substantially. In this case, the coupling unit 380 connected to the other end of the third link 346 heads downward to the lower side of the frame 314 to move beyond the bottom of the housing 310 through an opening 311 in the bottom of the housing 310, and is connected to the water supply nozzle 40.

In the meantime, referring to FIG. 6 again, the water spray unit 300 may further includes a water supply gun 370 to be connected to the coupling unit 380 for supplying the steam from the coupling unit 380 toward the cloth. In detail, the water supply gun 370 may be connected to the coupling unit with the water supply hose 360. The water supply hose 360 may be fabricated at a predetermined length appropriately. And, in order to enable the user to handle water supply gun 370 easily if the user holds the water supply gun 370 and supplies the steam, the water supply hose may be formed of a flexible material.

The water supply gun 370 and the water supply hose 360 described before may be housed in the housing space 312 of the housing 310. If the water supply gun 370 and the water supply hose 360 are provided to one side of the cabinet 10, not only storage thereof is not easy, but also appearance thereof is not good. Therefore, it is preferable that the housing space 312 is provided in the housing 310, for housing the water supply gun 370 and the water supply hose 360 therein. In the meantime, if the water supply gun 370 and the water supply hose 360 are housed in the housing 310, a hose fastening portion 362 for fastening the water supply hose 360 thereto, and a supply gun fastening portion 382 for fastening the water supply gun 370 thereto may be provided. That is, if the water spray unit 300 is not used, the user may dispose the water supply hose 360 along the hose fastening portion 362, and moreover, fastens the water supply gun 370 to the supply gun fastening portion 382, to re-arrange an inside of the housing 310. In the meantime, in order prevent the water supply hose 360 from interfering with the frame 314 if the water supply hose 360 is disposed in the housing 310, the frame 314 may have a recess 319 (referring FIG. 8). The water supply gun 370 for supplying the steam will be described, hereafter.

Figure 9:
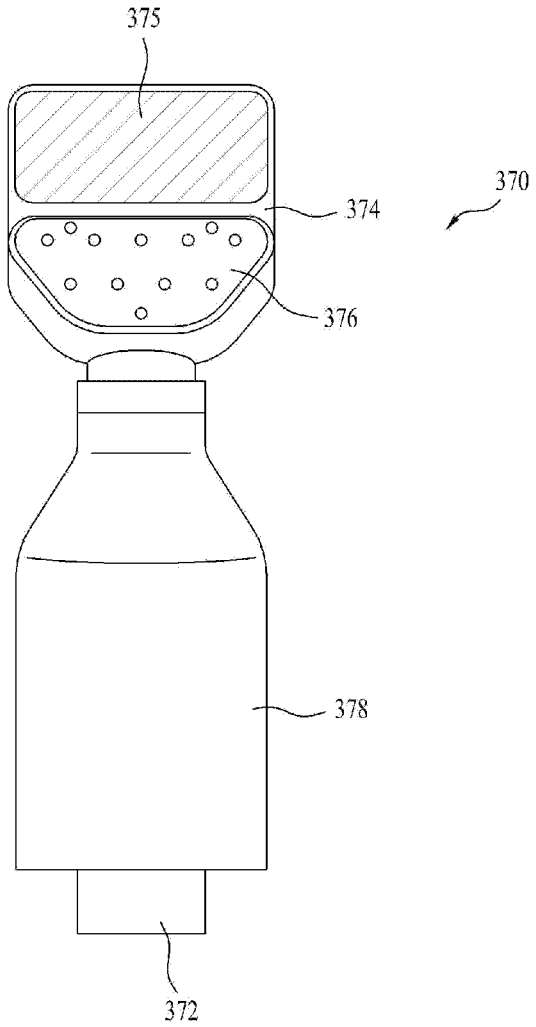
FIGS. 9 and 10 illustrate a front view and a side view of a water supply gun, respectively.
Figure 10:
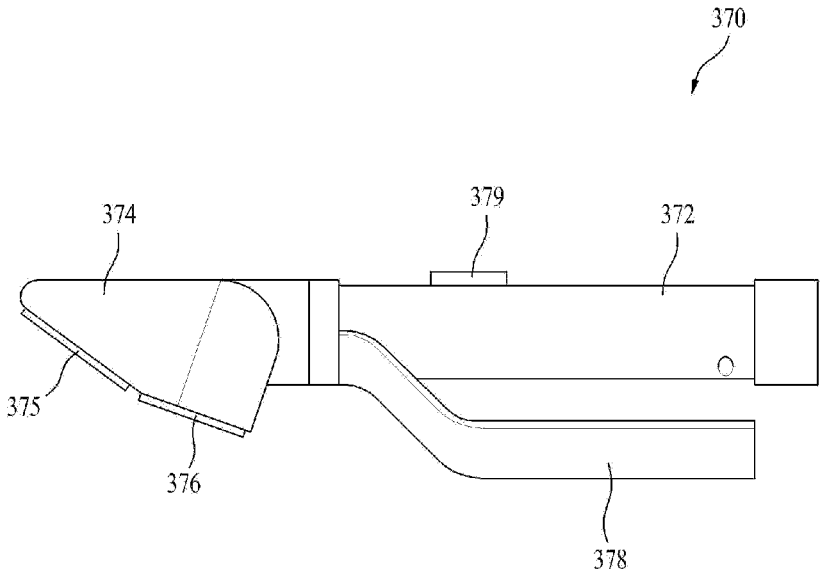

FIG. 9 illustrates a front view of the water supply gun 370, and FIG. 10 illustrates a side view of the water supply gun 370.

Referring to FIGS. 9 and 10, the water supply gun 370 may include a body 372 to be connected to the water supply hose 360, and a supply portion 374 provided to an end of the body 372 for supplying the steam. Though the supply unit 374 may be formed as one unit with the body 372, the supply unit 374 and the body 372 may be provided individually in view of easy fabrication as shown in the drawings. The supply portion 374 may have a supply area 376 at a front thereof with a plurality of steam supply holes for supplying the steam. And, the supply portion 374 may have a foreign matter removal portion 375 at the front thereof for removing foreign matter, such as lint, stuck to the cloth.

Referring to FIG. 10, the steam supply area 376 and the foreign matter removal portion 375 at the front of the supply portion 374 may be provided to have predetermined angles. If both the steam supply area 376 and the foreign matter removal portion 375 are formed at the supply portion 374 a front of which is formed flat, and if the foreign matter removal portion 375 is brought into close contact to the cloth to remove the foreign matter from the cloths, the steam supply area 376 will also be brought into close contact to the cloth in the same fashion. If the steam supply area 376 is in close contact to the cloth for supplying the steam to the cloth thus, making direct contact of the comparatively high temperature steam to the cloth, the steam may wet the cloth, on the contrary. Accordingly, the front of the supply portion 374 is divided into two regions to have predetermined angles for providing the steam supply area 376 and the foreign matter removal portion 375, individually. In a case of FIG. 10, even if the foreign matter removal portion 375 is brought into close contact to the cloth, the steam supply area 376 is not in close contact to the cloth, but is able to maintain a predetermined gap.

In the meantime, in order to prevent a user's hand or the like from exposing to the steam directly if the user uses the water supply gun 370, the water supply gun 370 may further include a protector 378. As shown in FIG. 10, the protector 378 may be provided extended from a lower side of the supply portion 374 to surround at least a portion of the body 372, and in order to secure a space the user's hand is to be placed therein, the protector 378 may be provided to form a predetermined space from the body 372.

In the meantime, the foregoing description describes a case the steam from the steam generating unit 32 in the water supply unit 30 is supplied through the water spray unit 300. However, a case the steam is generated by operating the heater in the steam generating unit 32 may be set in a variety of modes.

For an example, a control panel (Not shown) may be provided to a predetermined portion, for an example, to a front of the door 14, of the cloth treating apparatus, and the control panel may be provided with at least one course. By manipulating the control panel, the user may select a steam supply course and drives the cloth treating apparatus, to supply the steam through the water spray unit 300.

In another case, a predetermined manipulator 379 may be provided to the water supply gun 370 described before. In this case, the manipulator 379 may be provided with, for an example, a steam supply button and a steam supply cutoff button which are able to communicate with the control unit in the cloth treating apparatus with wire or wirelessly. Accordingly, if the user draws out the water supply gun 370 and manipulates the manipulator 379 of the water supply gun 370, the manipulator 379 transmits an order to the control unit to drive the steam generating unit 32 to supply the steam to the water spray unit 300. This case is advantageous in that the steam can be supplied at once by manipulating the water supply gun 370 without manipulation of the control panel on the main cabinet 100 of the cloth treating apparatus.

The operation of the water spray unit 300 having above configuration will be described with reference to the drawings.

Figure 11:
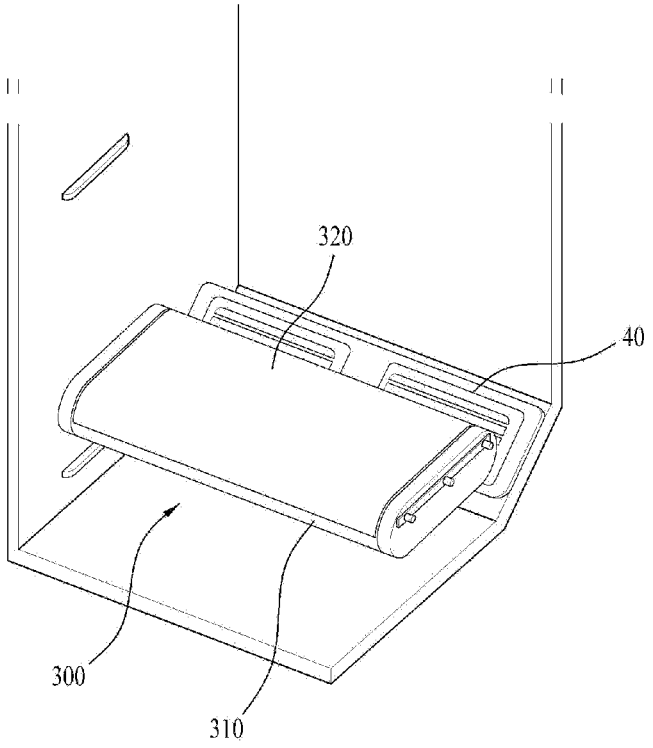
FIGS. 11 to 16 illustrate movements of a water spray unit, respectively.
Figure 12:
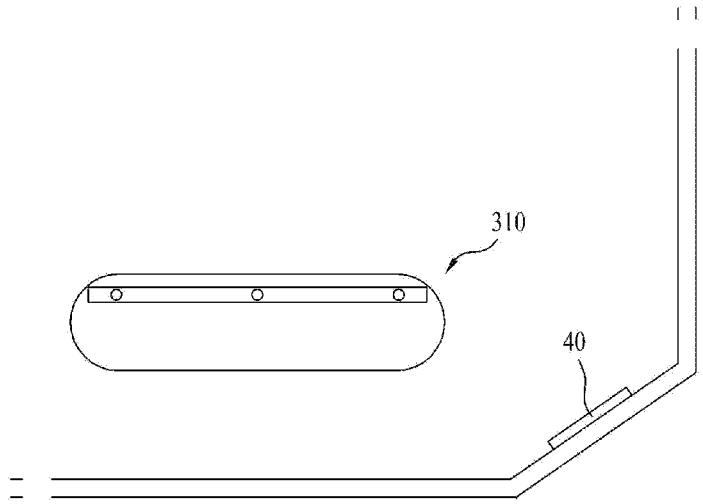
Figure 13:
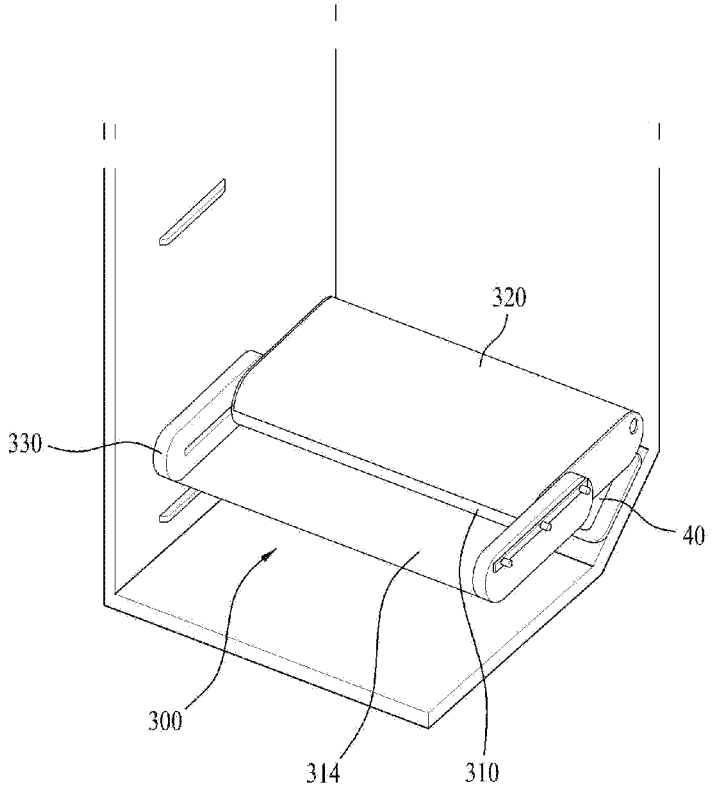
Figure 14:
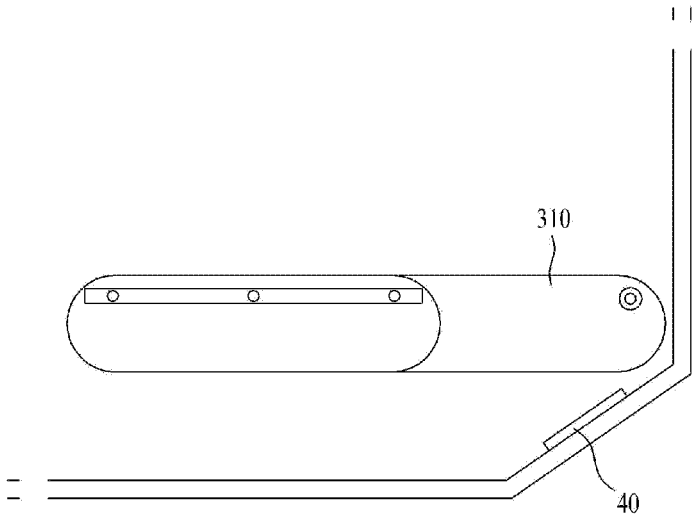
Figure 15:
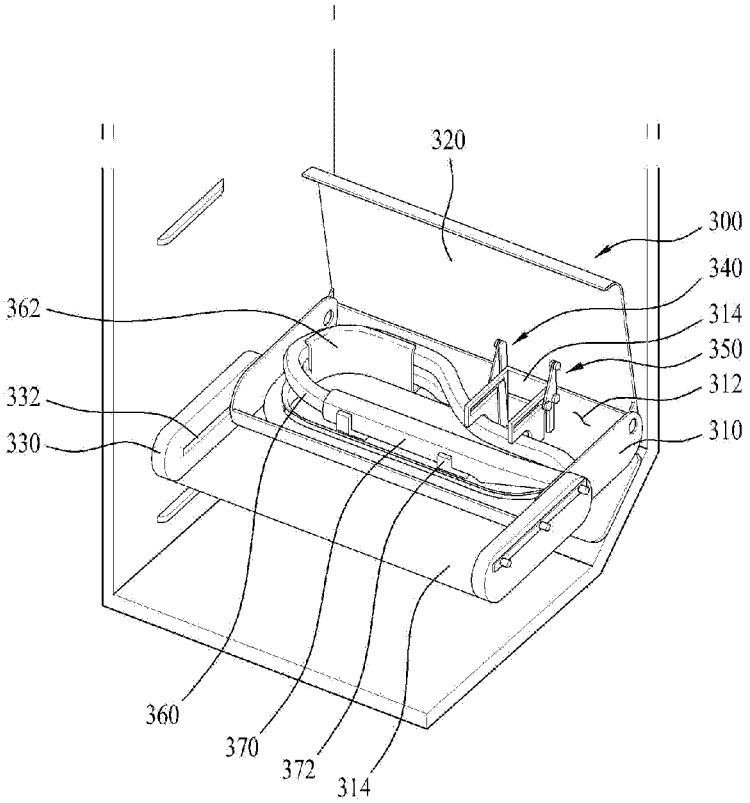
Figure 16:
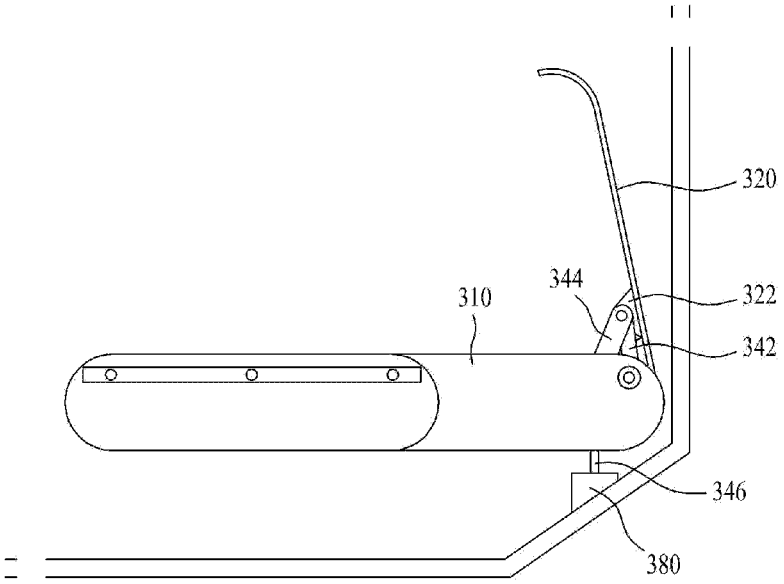

FIGS. 11 to 16 illustrate movements of the water spray unit 300, respectively. FIG. 11 illustrates a perspective view of a state the housing 310 of the water spray unit 300 is placed at the first position, showing the cloth treating apparatus partially, and FIG. 12 illustrates a side view of FIG. 11. FIG. 13 illustrates a perspective view of a state the housing 310 of the water spray unit 300 is placed at the second position, showing the cloth treating apparatus partially, and FIG. 14 illustrates a side view of FIG. 13. FIG. 15 illustrates a perspective view of a state the coupling unit 380 is connected to the water supply nozzle 40 as the cover 320 is opened, and FIG. 16 illustrates a side view of FIG. 15.

Referring to FIGS. 11 and 12, if steam supply from the water supply unit 30 is adequate, the user does not move the water spray unit 300 from the first position. Therefore, the water spray unit 300 stays at the first position, and the housing 310 maintains a predetermined space above the water supply nozzle 40.

Then, if the user intends to supply the steam with the water spray unit 300, as shown in FIG. 13, the user pushes the housing 310 along the guide rails 330 to place the housing 310 at the second position. In this case, the housing 310 is pushed backward as shown in FIG. 14 to position the opening 311 in a lower side of the housing 310 over the water supply nozzle 40.

Then, referring to FIGS. 15 and 16, the user opens the cover 320 on the housing 310, moving the coupling unit 380 to the lower side of the housing 310 owing to the connection unit 341 interlocked with the opening action of the cover 320 such that the coupling unit 380 is connected to the water supply nozzle 40. The user may take out the water supply gun 370 and the water supply hose 360 from an inside of the housing 310, and may supply the steam to a portion the user intends to supply, intensively.

Figure 17:
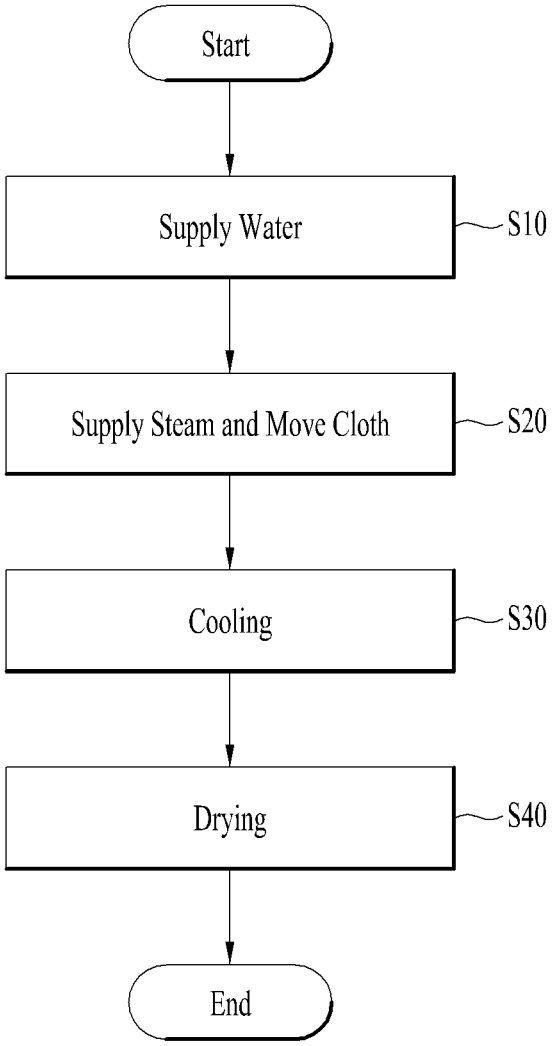
FIG. 17 illustrates a flow chart showing the steps of a method for controlling a cloth treating apparatus in accordance with a preferred embodiment of the present invention, performed at a main cabinet.

FIG. 17 illustrates a flow chart showing the steps of a method for controlling a cloth treating apparatus in accordance with a preferred embodiment of the present invention, performed at a main cabinet.

Referring to FIG. 17, the method includes a step S10 for supplying water to a water supply unit which supplies the water or steam, a step S20 for applying horizontal movement to cloth for a predetermined time period while supplying the steam by heating the water in a steam generating unit, a step S30 for cooling the cloth, and a drying step S40 for supplying heated air of a predetermined temperature to a housing space. The method of the embodiment performs wrinkle removal, deodoring, static electricity prevention, and so on from the cloth by supplying the steam, the air, or the heated air.

At first, the control unit supplies the water to the water supply unit 30 (S10). In this case, the control unit supplies the water to the steam generating unit 32 up to a full water level thereof. For this, the steam generating unit may have a water level sensor in the steam generating unit for sensing a water level. The control unit supplies the water until the water reaches to the full water level according to the water level sensed at the water level sensor.

In the meantime, the control unit may further perform a heating step for heating the water in the steam generating unit to a predetermined temperature in the water supply step. This is for reducing a water heating time period required for generating the steam in a steam supplying step to be described later wherein the water is heated at the same time with the water supply or the water is not heated until a predetermined time period is passed after the water supply. In the meantime, the steam generating unit may be provided with a heater or the like for heating the water therein.

Then, the control unit heats the water in the steam generating unit to supply the steam to the housing space and, at the same time with this, applies the horizontal movement to the cloth S20. The control unit heats the water with the heater in the steam generating unit 32 to supply the steam. In the meantime, the control unit supplies the steam and, at the same time with this, drives the movable hanger 50 to apply the movement to the cloth. Particularly, the control unit drives the movable hanger 50 to apply the horizontal movement to the cloth, for an example, horizontal linear movement, horizontal closed curve movement, or horizontal reciprocating movement of a predetermined rpm. Since the movement is applied at the same time with supply of the steam, making the cloth to be brought into contact with the steam much more compared to a case the cloth does not move, but is standstill, the effects of the wrinkle removal, the deodoring, the static electricity prevention, and so on owing to the steam become significant. The time period of supplying the steam may be controlled according to kinds/materials/attribution of the cloth appropriately, and a steam supply time period for each kind of the cloths may be stored in the control unit in advance. In the meantime, the application of the movement to the cloth may be continuous during the steam supply time period, or repetitive in a predetermined period.

After supply of the steam, the control unit supplies unheated air to the cloth for a predetermined time period to cool the cloth S30. This is performed by, not driving the heat pump 22, but driving only the fan 32, to supply the unheated air to the first housing space 12. Owing to this, an inside temperature of the first housing space 12, and the cloth therein heated by the supply of the steam can drop.

Then, the control unit supplies the air heated and dried by the heat pump 22 to the first housing space 12 to dry the cloth. In a case the cloth is dried, the control unit controls the heat pump 22 to supply the heated air at a temperature in a range of 45~60° C., preferably, in a range of 50~55° C. The cloth which contains much moisture owing to the steam supply is dried by the heated air to turn into a state the user feels comfortable to put on. In the meantime, in the control method of the embodiment, the control unit may include a step of applying the movement to the cloth in the drying step. That is, in a case the heated air is supplied to the housing space 12, movement in a predetermined direction may be applied to the cloth. By applying the movement to the cloth at the same time with supply of the heated air, increasing a contact area between the cloth and the heated air, a drying effect can be enhanced. The step for applying the movement to the cloth is performed by driving the movable hanger 50, which is similar to the movement in the steam supply step, and, therefore, will be omitted.

Figure 18:
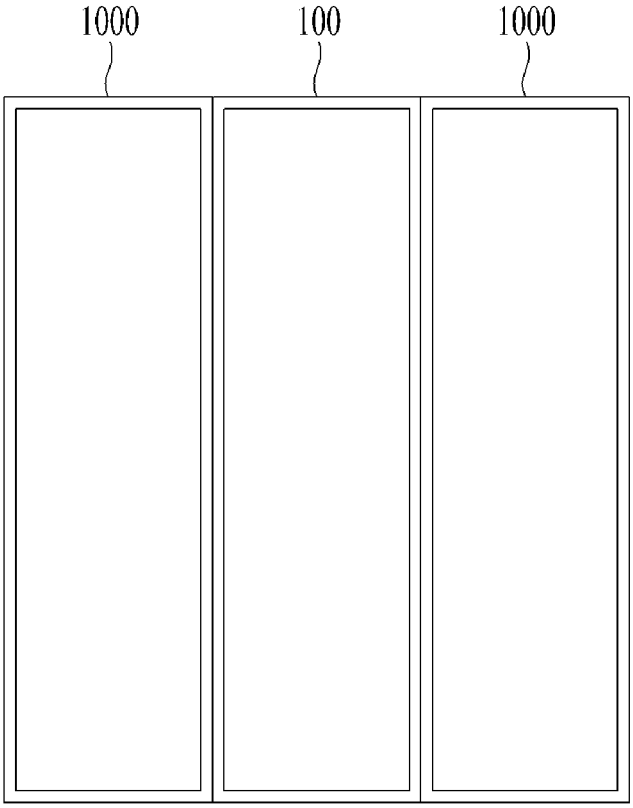
FIG. 18 illustrates a front view of a cloth treating apparatus in accordance with a preferred embodiment of the present invention.

FIG. 18 illustrates a front view of a cloth treating apparatus in accordance with a preferred embodiment of the present invention.

The cloth treating apparatus of the embodiment includes a main cabinet 100 and a supplementary cabinet 1000 arranged adjacent to the main cabinet 100. The cloth treating apparatus of the present invention may have plural, i.e., at least one, i.e., two, three, or so on of the supplementary cabinets 1000.

Referring to FIG. 18, the supplementary cabinets 1000 may be arranged on both sides of the main cabinet 100 symmetrically, with the main cabinet 100 arranged therebetween, i.e., in a fashion in which the supplementary cabinet 1000 is arranged on a leftmost side, the main cabinet 100 is arranged on a right side of the supplementary cabinet 1000 arranged on a leftmost side, and the supplementary cabinet 1000 is arranged on the rightmost side. In this case, for user's convenience, the supplementary cabinet 1000 may be arranged on one side of the supplementary cabinet 1000, additionally.

In a case the air supply unit and the water supply unit are mounted only to the main cabinet 100, but not to the supplementary cabinet 1000, as each of the supplementary cabinets 1000 can be arranged close to the main cabinet 100, the case is advantageous in that pipelines connected to the air supply unit and the water supply unit are not required to be long.

As an example of a variation of the arrangement shown in FIG. 18, the supplementary cabinets 1000 may be arranged spaced from the main cabinet 100, with the main cabinet 100 arranged between the supplementary cabinets 1000. In this case, wire or wireless communication is made between the main cabinet 100 and the supplementary cabinet 1000, to enable the main cabinet 100 to control cloth treatment being performed at the supplementary cabinets 1000.

If the main cabinet 100 and the supplementary cabinets 1000 are arranged spaced from each other, it is preferable that the air supply unit and the water supply unit are mounted to each of the main cabinet 100 and the supplementary cabinets 1000, individually. According to this, not only the air supply unit and the water supply unit mounted to the main cabinet 100, but also the air supply unit and the water supply unit mounted to each of the supplementary cabinets 1000 may be controlled by the control unit at the main cabinet 100, altogether.

Figure 19:
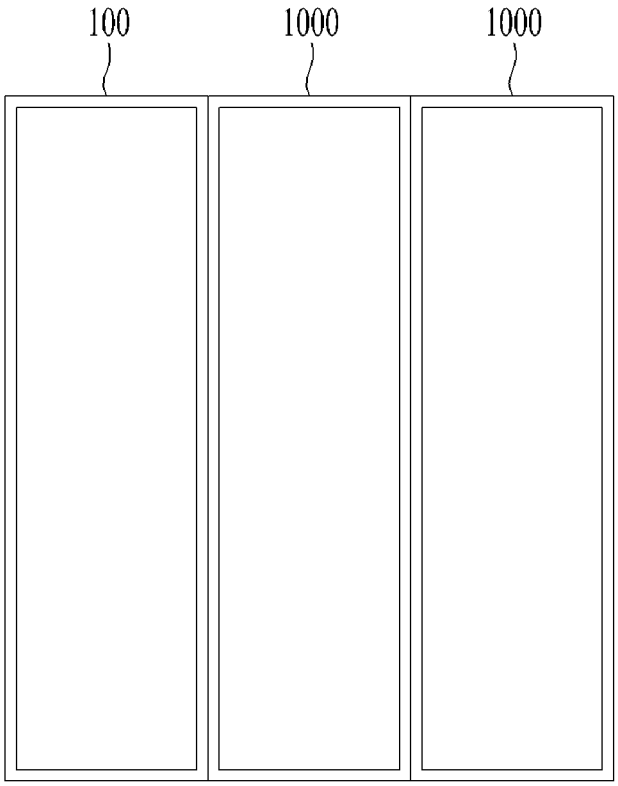
FIG. 19 illustrates a front view of a cloth treating apparatus in accordance with another preferred embodiment of the present invention.

FIG. 19 illustrates a front view of a cloth treating apparatus in accordance with another preferred embodiment of the present invention.

Different from FIG. 18, FIG. 19 illustrates the main cabinet 100 arranged not at a center, but on an outer side of the cloth treating apparatus. In other words, the main cabinet 100 is arranged on a leftmost side, the supplementary cabinet 1000 is arranged on a right side of the main cabinet 100, and a new supplementary cabinet 1000 is arranged on a rightmost side of the cloth treating apparatus.

Of course, different from this, it is possible that the main cabinet 100 is arranged on the rightmost side, and a plurality of the supplementary cabinets 1000 may be arranged on the left side of the main cabinet 100. Or, as a variation, the main cabinet 100 and the supplementary cabinets 1000 may be arranged spaced a predetermined distance from each other to communicate with wire or wirelessly.

If the main cabinet 100 and the supplementary cabinets 1000 are arranged spaced a predetermined from each other, it is preferable that the air supply unit and the water supply unit are mounted to the main cabinet 100 and the supplementary cabinets 1000, individually. According to this, not only the air supply unit and the water supply unit mounted to the main cabinet 100, but also the air supply unit and the water supply unit mounted to each of the supplementary cabinets 1000 may be controlled by the control unit at the main cabinet 100, altogether.

Figure 20:
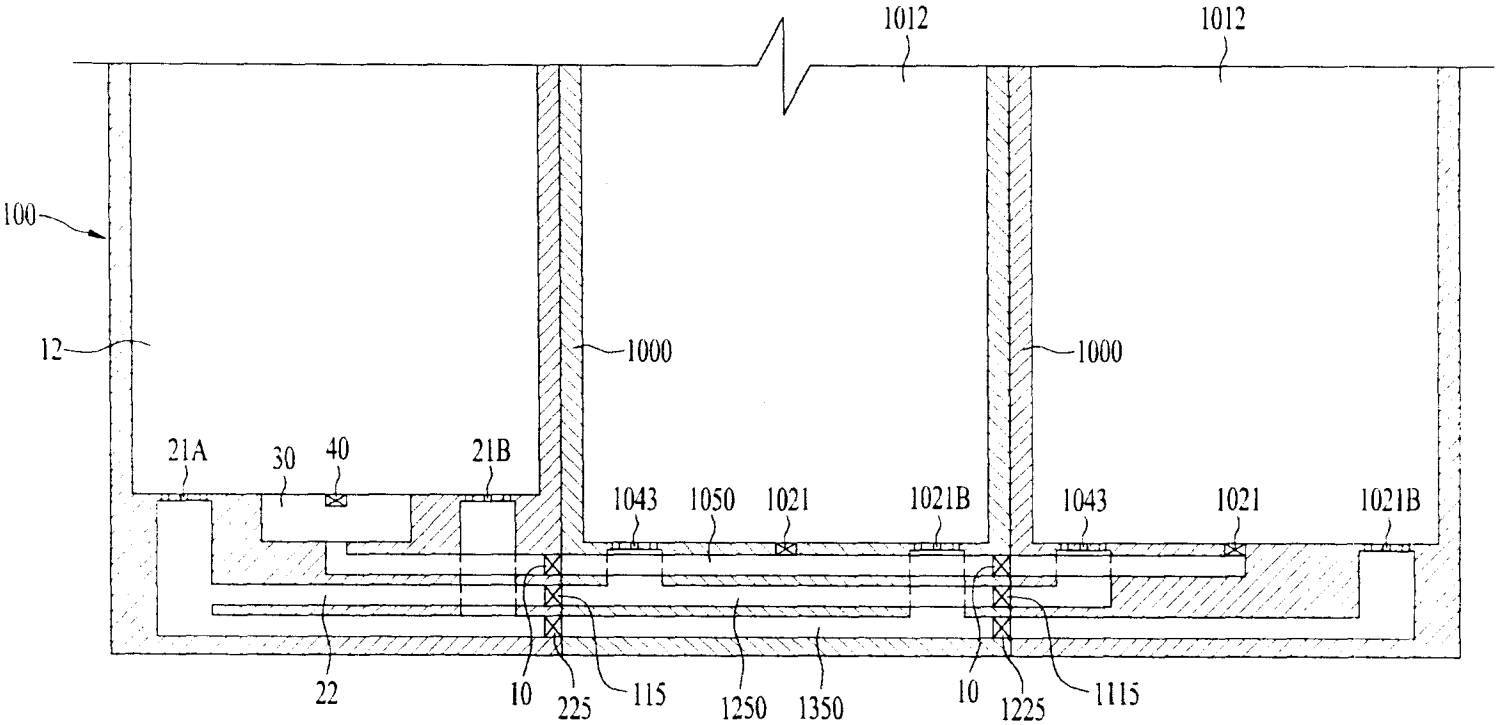
FIG. 20 illustrates a section of an inside of the machinery room in FIG. 19, schematically.

FIG. 20 illustrates a section of an inside of the machinery room in FIG. 19, schematically.

Alike FIG. 19, FIG. 20 illustrates a cloth treating apparatus having the main cabinet 100 arranged at the leftmost side thereof, and two sets of the supplementary cabinets 1000 arranged on a right side of the main cabinet 100. In this case, a water outlet 15 from the main cabinet 100 is provided to a side of the main cabinet 100. The water outlet 15, different from the water supply nozzle 40 which discharges the steam or the water to the first housing space 12 of the main cabinet 100, is an additional element for spraying the water or the steam from the main cabinet 100 to the second housing space 1012 in the supplementary cabinet 1000.

That is, since the supplementary cabinet 1000 has no water supply unit provided thereto, but the steam generated a the water supply unit 30 in the main cabinet 100 is supplied to the supplementary cabinet 1000, the water supply unit 30 in the main cabinet 100 is an element which is used by the main cabinet 100 and the supplementary cabinet 1000, in common.

Of course, though the water outlet 15 may be formed anywhere in a surface where the main cabinet 100 and the supplementary cabinet 1000 meet, for convenience of arrangement, it is preferable that the water outlet 15 is formed in a surface at which the machinery room of the main cabinet 100 is positioned.

In order to supply the water to the supplementary cabinet 1000 through the water outlet 15, it is required to provide a water supply flow passage 1050 to the supplementary cabinet. And, it is preferable that a water supply nozzle 1021 is formed at the water supply flow passage for spraying the steam or the water to an inside of the second housing space 1012 in the supplementary cabinet 1000.

That is, the water outlet 15 is in communication with the second housing space 1012 in the supplementary cabinet 1000, preferably, with a bottom of the first housing space 12 in the main cabinet 100.

In the meantime, FIG. 20 illustrates the supplementary cabinets 1000 arranged side by side on one side of the main cabinet 100. However, different from this, as shown in FIG. 18, the arrangement of FIG. 20 may be changed to an arrangement in which the supplementary cabinets 1000 are arranged on both sides of the main cabinet 100. Such a change may be embodied by changing a position of the water outlet 15 of the main cabinet 100, easily. Particularly, in this case, it is preferable that the water outlet 15 is positioned on both sides of the main cabinet 100. This is because, as the two supplementary cabinets 1000 are arranged on both sides of the main cabinet 100, the water or the steam is required to be supplied to the two supplementary cabinets 1000 from the water supply unit 30 mounted to the main cabinet 100.

In the meantime, the main cabinet 100 may have, not only the water supply unit 30, but also the air supply unit 22 provided thereto, additionally. The main cabinet 100 has, not only the water outlet 15, but also at least one air outlet 115 formed therein. Of course, depending on opening/closing of the air outlet 115, the air or the heated air is supplied to the second housing space 1012, selectively.

In this case, it is preferable that the supplementary cabinet 1000 has an air flow passage 1250 provided thereto to be in communication with the air outlet 115, and it is preferable that the air flow passage 1250 has an air outlet 1021B provided therein for supplying the air or the heated air to the supplementary cabinet 1000.

As described in description of the water supply unit 30, the arrangement of FIG. 20 may be changed to an arrangement in which the supplementary cabinets 1000 are arranged on both sides of the main cabinet 100. In order to embody the cloth treating apparatus of this type, it is required to provide the air outlet 115, not on one side, but two sides of the main cabinet 100. This is because it is required to provide two air outlets 115 connected to the supplementary cabinets 1000 respectively for supplying the air or the heated air from the air supply unit 22 to the supplementary cabinets 1000 arranged on both sides of the main cabinet 100, respectively.

In the meantime, depending on a circulation mode of the air or the heated air, a discharge hole (Not shown) may be formed in a top side of the second housing space 1012 of the supplementary cabinet 1000 for discharging the air from an inside of the second housing space 1012 to an outside thereof. In such a mode, external air is introduced to the air supply unit 22 in the main cabinet 100, and after the heated air is supplied to the first housing space 12 or the second housing space 1012, wet air will be discharged through the discharge hole formed in each of the cabinets.

Moreover, the air supply unit 22 of the embodiment may further include a condenser 28. Since this type of the air supply unit 22 is described with reference to FIG. 5, description of the air supply unit type will be omitted in FIG. 20, for convenience of description.

In this case, it is preferable that the supplementary cabinet 1000 has a condensing flow passage 1350 provided additionally for recovering the air from the second housing space 1012. And, the condensing flow passage 1350 has an air inlet 1043 formed therein for introduction of the air thereto.

That is, the air in the second housing space 1012 of the supplementary cabinet 1000 is introduced to the air supply unit 22 in the main cabinet 100 through the air inlet 1043 and the condensing flow passage 1350. The air supply unit 22 will remove the water from the air, heat the air, and supply the air or the heated air to the housing spaces of the cabinets, again.

Therefore, it is preferable that the main cabinet 100 has an air recovery hole 225 for re-introduction of the air from an adjacent cabinet thereto, preferably opening/closing as necessary, selectively.

That is, as the supplementary cabinets 1000 are only provided with the flow passage 1050 for supplying the water thereto, the flow passage 1250 for supplying the air or the heated air thereto, and the condensing flow passage 1350 for condensing the water contained in the air as necessary, embodiment of such a cloth treating apparatus is possible.

In the meantime, the water outlet 15, the air outlet 115, and the air recovery hole 225 may be opened/closed as necessary, selectively. That is, by opening/closing the water outlet 15, the air outlet 115, and the air recovery hole 225 in the main cabinet 100, or the water outlet 1015, and the air outlet 115 in the supplementary cabinet 1000 appropriately, embodiment of a variety of the cloth treating apparatuses may also be possible. For an example, It may also be possible that both the steam and the heated air is supplied to the main cabinet 100, and only the heated air is supplied to the two supplementary cabinets 1000.

In general, a process of putting the heater into operation to generate the steam in the steam generating unit 32 requires largest power consumption among different modes of cloth treating menus to be made in the main cabinet 100. This is because the steam generating unit 32 boils the water held therein at a high temperature to generate the steam, quickly. Therefore, in a case, if the water or the steam is provided to the first housing space 12 and the second housing space 1012 at a time, the power consumption of the case is out of a range of power consumption permitted to use domestically, to cause an overload and a problem of black out, or the like.

Therefore, in the present invention, if the steam is being supplied to the first housing space 12, it is preferable that the steam is not supplied to the two second housing spaces 1012 at the same time. Alikely, if the water or the steam is being supplied to one of the two second housing spaces 1012 of the supplementary cabinets 1000, the water or the steam is not supplied to the other one of the second housing spaces 1012 and the first housing space 12. That is, since the cloth treating apparatus is operated not to supply the water or the steam to two housing spaces at the same time, the power can be supplied to the cloth treating apparatus, securely.

Especially, a system for controlling the valves mounted to respective flow passages may be applied to a method for supplying the steam or the water to one housing space selected from the plurality of the housing spaces.

Opposite to this, the heated air or the air can be supplied to the plurality of housing spaces from the air supply unit 22. Even if the heater is in operation when the heated air is supplied to the housing spaces from the air supply unit 22, in general, a capacity of the heater used in the air supply unit 22 is smaller than the capacity of the heater used in the steam generating unit 32. This is because the air, not the water, is heated in the air supply unit 22.

Of course, the air supply unit 22 may also supply the air or the heated air to one of the plurality of the housing spaces, selectively. By supplying the air or the heated air only to selected one of the plurality of housing spaces, overloading an element, such as the heater or the fan in the air supply unit 22, can be prevented.

Figure 21:
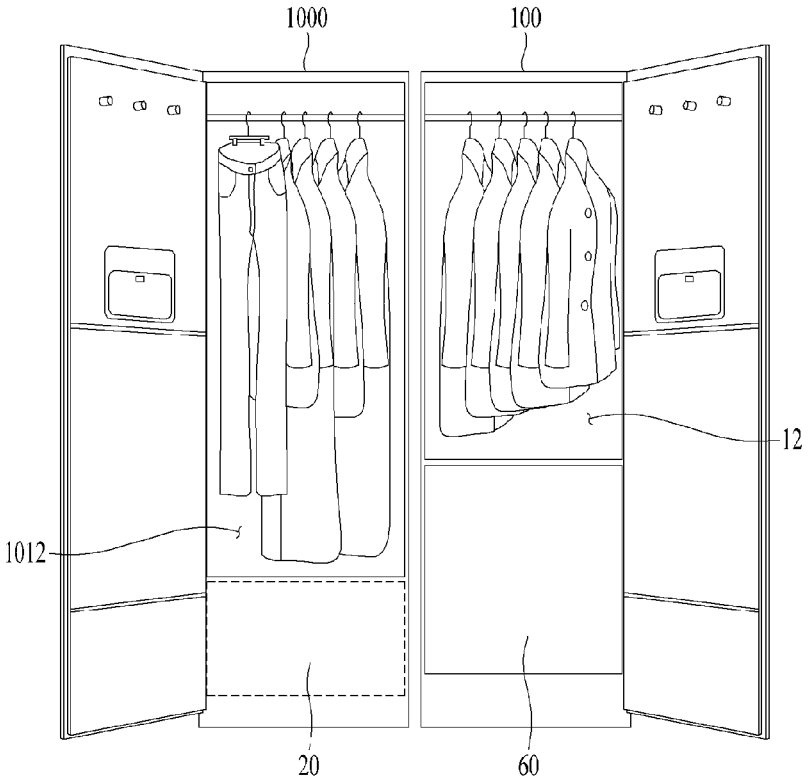
FIG. 21 illustrates a front view of a cloth treating apparatus in accordance with another preferred embodiment of the present invention.

FIG. 21 illustrates a front view of a cloth treating apparatus in accordance with another preferred embodiment of the present invention.

Referring to FIG. 21, another embodiment discloses one main cabinet 100, and a supplementary cabinet 1000 installed to one side of the main cabinet 100. However, as shown in FIGS. 18 and 19, two supplementary cabinets 1000 may be installed, or three or more than three supplementary cabinets 1000 may be installed. Such an arrangement may be made according to convenience of the user.

The main cabinet 100 shown in FIG. 21 has a configuration in which the machinery room 20 is closed with the door module 60 provided to an inside of the main cabinet 100 as shown in FIG. 1 or 2.

However, the supplementary cabinet 1000 has a machinery room 20 formed smaller than the machinery room in the main cabinet 100. Since the supplementary cabinet 1000 does not require the air supply unit 22 and the water supply unit 30 mounted to the main cabinet 100, spaces of the machinery room required for mounting above elements are empty.

Of course, referring to FIG. 20, though the supplementary cabinet 1000 has the air supply flow passage and the water supply flow passage provided thereto, despite of provision of such elements to the supplementary cabinet 1000, there can be a difference of sizes of the first housing space 12 and the second housing space 1012.

Therefore, in order to improve space utilization, the machinery room 20 of the supplementary cabinet 1000 is made to have a size smaller than the machinery room of the main cabinet 100, enabling to increase the size of the space of the second housing space 1012 of the supplementary cabinet 1000 to be larger than the first housing space 12 of the main cabinet 100. Particularly, since the machinery room 20 is arranged on a lower side of each of the housing spaces, the second housing space 1012 has, not a width thereof, but a length thereof, increased compared to the first housing space 12.

That is, it is possible that the second housing space 1012 can have the cloth housed therein, which is longer than the cloth which can be housed in the first housing space 12. For an example, if the first housing space 12 can house a shirt or a jacket, the second housing space 1012 can house a coat or trousers which are longer than the shirt or the jacket.

In the meantime, while housing the cloth in the second housing space 1012, having a length similar to the cloth housed in the first housing space 12, the water spray unit 300 described before may be stored therein. Since the water spray unit 300 occupies a portion of the housing space the cloth is to be housed therein actually, a space in the housing space for housing the cloth is reduced, actually. Therefore, by storing or mounting the water spray unit 300 in an enlarged space of the second housing space 1012, unnecessary reduction of the first housing space 12 can be prevented.

Of course, not the water spray unit 300, but various accessories may be stored in the second housing space 1012.

In the meantime, it may also be possible to store large shoes and the like which have a contamination level higher than other cloth, with the shoes enclosed in the second housing space 1012. For an example, there is a problem in that, if cloth treatment is performed for a general outer garment and the shoes, a bad odor may transmit from the shoes to the general outer garment. Therefore, it is possible to provide a portion of a space of the second housing space 1012 as an exclusive shoe space for separate treatment of the shoes.

Of course, it is possible to mount a shelf to a lower side of the second housing space 1012 for placing different kinds of cloths thereon. Since the shelf divides the housing space, a height of an entire housing space on which the cloth is placed is reduced. Therefore, rather than reducing a height of the first housing space 12, dividing the height of the second housing space 1012 which is higher than the height of the first housing space 12 enables to place the cloth thereon with enhanced space efficiency.

However, different from this, it is possible that the machinery room of the main cabinet 100 and the machinery room of the supplementary cabinet 1000 are formed to have the same sizes, but only elements mounted to the machinery rooms are made different from each other. That is, by arranging the air supply unit 22 and the water supply unit 30 and peripheral elements thereof of the main cabinet 100 different from the supplementary cabinet 1000, the supplementary cabinet 1000 may be fabricated. Since this case enables to fabricate the supplementary cabinet 1000 as a slight variation from the same shape of the main cabinet 100, the supplementary cabinet 1000 can be fabricated more easily.

However, if machinery room of the main cabinet 100 and the machinery room of the supplementary cabinet 1000 are formed the same with each other, making not only the sizes, but also the shapes of the first housing space 12 and the second housing space 1012 the same, space utilization of the housing space in which the cloth is housed becomes poorer than the foregoing example.

Figure 22:
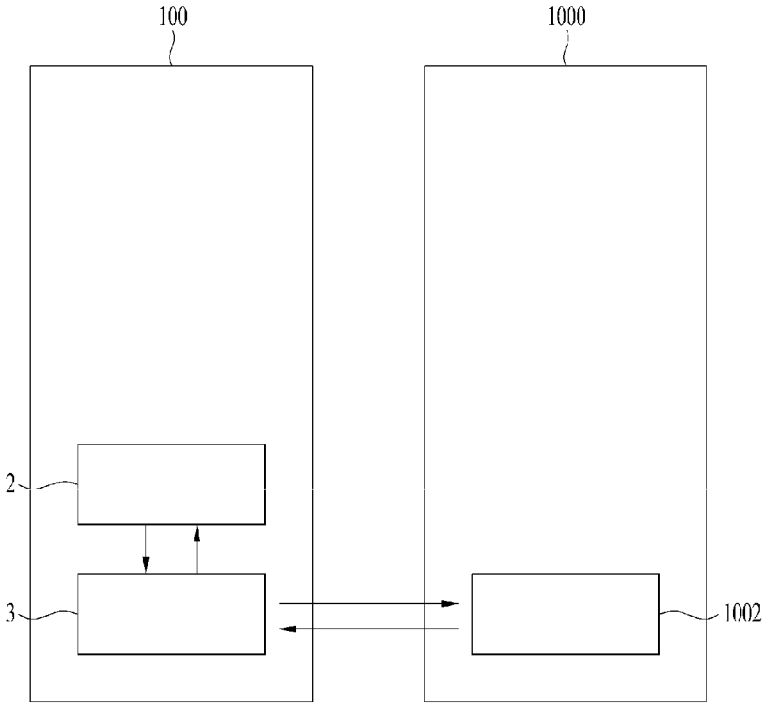
FIG. 22 illustrates a block diagram of a cloth treating apparatus in accordance with another preferred embodiment of the present invention.

FIG. 22 illustrates a block diagram of a cloth treating apparatus in accordance with another preferred embodiment of the present invention.

Referring to FIG. 22, the main cabinet 100 has a control unit 2 mounted thereto for controlling the air supply unit 22 and the water supply unit 30. The control unit may turn on or turn off the air supply unit 22 and the water supply unit 30.

And, the control unit may control valves mounted to respective flow passages for selective supply of the steam or the water from the water supply unit 30 to the first housing space 12 or the second housing space 1012. That is, the control unit 2 may close the flow passage of the air supply unit 22 in communication with the first housing space 12 and open the flow passage of the air supply unit 22 in communication with the second housing space 1012 for supplying the heated air or the air to the second housing space 1012.

Opposite to this, it is possible that, even though all flow passages in communication with the air supply unit 22 are opened, the air or the heated air supply both to the first housing space 12 and the second housing space 1012 may be blocked by turning off the air supply unit 22.

Alikely, the steam or water may be supplied only to the first housing space 12 by opening the valve in communication with the first housing space 12 only and closing the valve in communication with the second housing space 1012 even though the water supply unit 30 is driven. Opposite to this, by opening the valve in communication with the second housing space 1012 only and closing the valve in commutation with the first housing space 12 in a state the water supply unit 30 is driven, the steam or the water may be supplied to the second housing space 1012, only.

And, the control unit 2 may determine or store a menu required for cloth treatment the user inputs. The user can treat the cloths according to individual characteristic of the cloths housed in a plurality of the housing spaces. For this, it is required to select cloth treating menus different from one another for the housing spaces. Menu information on the cloths the user inputs may be stored in, and processed by, the control unit 2.

The main cabinet 100 may have a main communication unit 3 mounted thereto for transmission/reception of different signals to/from the control unit 2.

And, the supplementary cabinet 1000 may have a supplementary communication unit 1002 mounted thereto for transmission/reception of different signals to/from the control unit 2. In this case, the main communication unit 3 and the supplementary communication unit 1002 may be connected with wire or wirelessly.

If the main communication unit 3 and the supplementary communication unit 1002 are connected wirelessly, which is advantageous in that communication cables are not exposed to an outside of the cloth treating apparatus, the main cabinet 100 and the supplementary cabinet 1000 may be arranged adjacent to, or spaced from, each other.

In conclusion, since the control unit 2 can exchange information with the supplementary communication unit 1002, the control unit 2 may control different elements mounted to the supplementary cabinet 1000. Particularly, by controlling the valves mounted to the supplementary cabinet 1000, the control unit 2 may control the cloth housed in the second housing space 1012 of the supplementary cabinet 1000.

Figure 23:
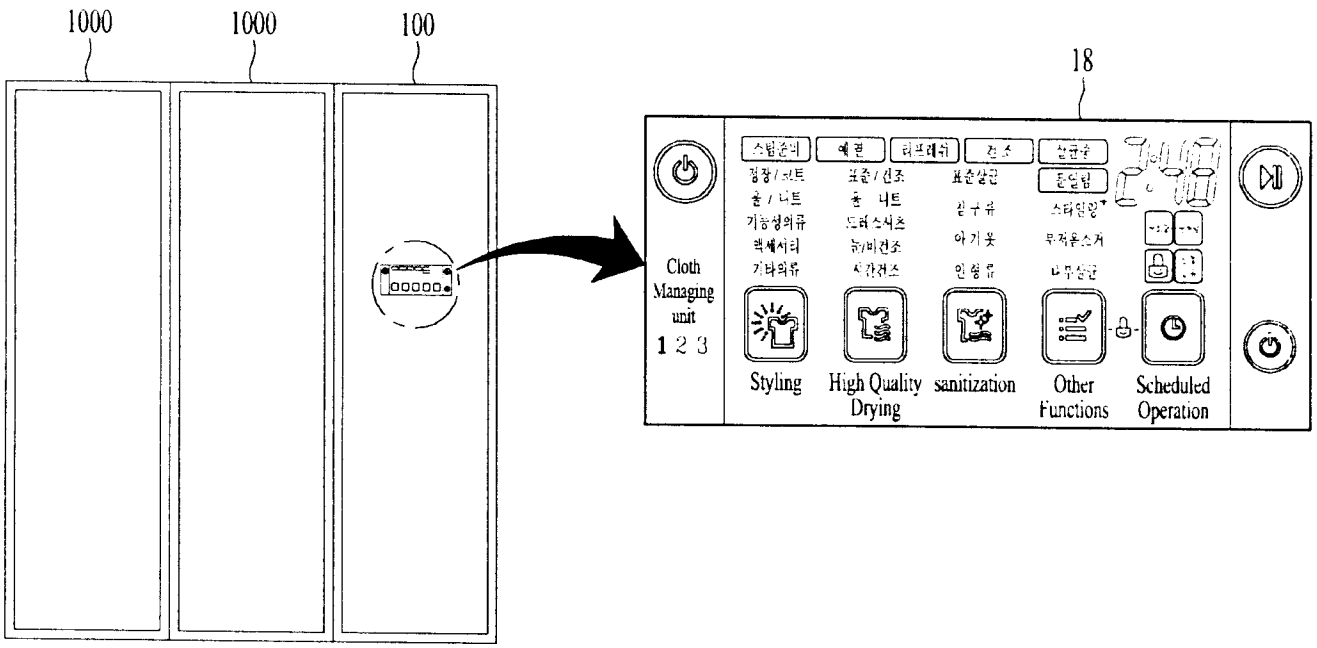
FIG. 23 illustrates a front view of a cloth treating apparatus in accordance with another preferred embodiment of the present invention.

FIG. 23 illustrates a front view of a cloth treating apparatus in accordance with another preferred embodiment of the present invention.

Referring to FIG. 23, the cloth treating apparatus has the main cabinet 100 installed on a rightmost side thereof, and two sets of the supplementary cabinets 1000 installed on a left side of the main cabinet 100. A display unit 18 is mounted only to the main cabinet 100 installed on the rightmost side of the cloth treating apparatus for displaying information on performance of a cloth treatment process.

Of course, even in a case the main cabinet 100 is arranged at a center of the cloth treating apparatus and the two supplementary cabinets 1000 are arranged on both sides of the main cabinet 100, the display unit 18 may be provided to the main cabinet 100.

As described with reference to FIG. 22, the control unit 2 may be provided to the main cabinet 100. Alikely, as shown in FIG. 23, the display unit 18 which displays information on the cloth treatment to the user may be provided to a front of the main cabinet 100. Though the display unit 18 may be mounted, not only to the main cabinet 100, but also to the supplementary cabinet 1000 individually, it is preferable that the display unit 18 is provided only to the main cabinet 100 for preventing the user from confusing in controlling respective cabinets.

The user may recognize the cloth treating process performed, not only at the main cabinet 100, but also at the plurality of supplementary cabinets 1000 with the display unit 18 mounted to the main cabinet 100. Both detailed cloth treating process performed at the first housing space 12, and detailed cloth treating process performed at the second housing space 1012 may be displayed on the display unit 18.

Especially, in the embodiment shown in FIG. 23, an order of an intended cabinet may be selected from the menus on a cloth management unit on a left side of the display unit 18. If the intended cabinet is selected, the user may recognize detailed information on the cloth treatment being performed at the intended cabinet, i.e., the intended housing space, with the display unit 18.

And, the user can input a menu required for cloth treatment with the display unit 18. That is, as an example, of the menus the cloth treating apparatus can provide to the cloth, such as styling, high quality drying, sanitization, and so on, the user may perform styling for the cloth housed in the first housing space 12, and sanitization for the cloth housed in the second housing space 1012. Thus, all the menus the user desires may be inputted with the display unit 18 mounted to the main cabinet 100.

A method for inputting a cloth treatment menu to respective desired housing spaces is similar to a method for recognizing information on the cloth treatment performed at respective housing spaces. The user may select an intended cloth management unit, i.e., a cabinet, and input the menu related to desired cloth treatment with FIG. 23.

An input order may be stored in the control unit 2 and reflected to cloth treating priorities of the cloths housed in respective housing spaces. Opposite to this, priorities of cloth treating being performed at respective housing spaces may be determined according to cloth treating menus being performed at respective housing spaces.

And, the control unit 2 has information on respective detailed courses being performed according to the menus the user selects stored therein. For an example, of the cloth treating menus, information on drying, such as a time period for supplying the water or the steam, a supply rate of the water or the steam, and so on, is preset at the control unit 2. Alikely, since the control unit has detailed cloth treating courses for styling, and sanitization, which are menus different from each other stored therein, the cloth housed in the housing space is treated according to the selected menu.

Figure 24:
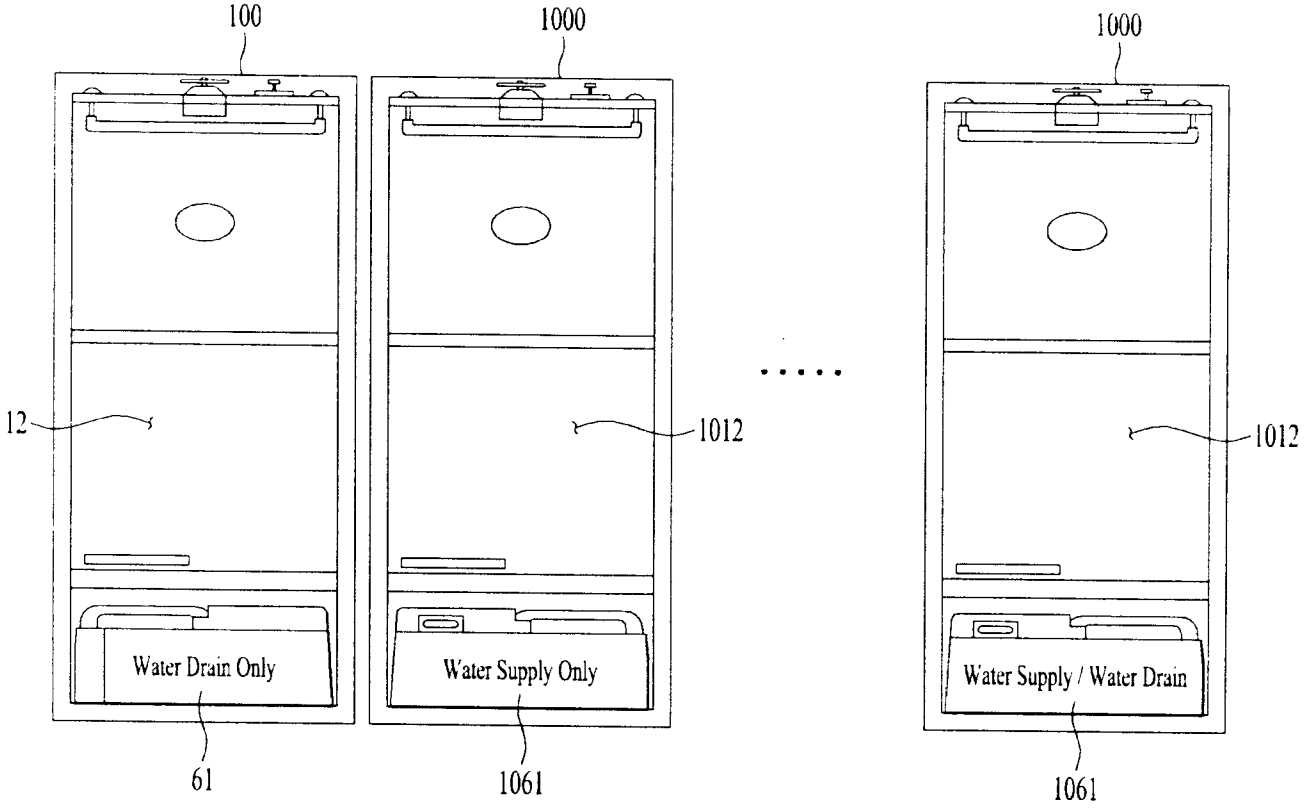
FIG. 24 illustrates a conceptual drawing of a cloth treating apparatus in accordance with another preferred embodiment of the present invention.

FIG. 24 illustrates a conceptual drawing of a cloth treating apparatus in accordance with another preferred embodiment of the present invention.

Referring to FIG. 24, each of the cabinets may have a water supply tank mounted thereto for supplying or draining water, respectively. As shown in FIG. 5, it is possible that the water supply tank 61 is mounted adjacent to the door module 60. In this case, the water supply tank 61 may be a water drain tank for draining from the cabinet or a water supply tank for supplying the water to the cabinet. The water supply tank 61 has a space formed therein for receiving and holding the water, and a size enough to be housed in the machinery room 20.

And, the water supply tank 61 has a hole in one side thereof for introduction or draining the water to/from the water supply tank 61.

When the water supply tank 61 serves a function of a water supply tank for supplying the water, the water supply tank 61 may supply the water to elements which require water supply of the elements mounted to the cabinets. For an example, the water supplied to the water supply tank may supply the water to the water supply unit 30 mounted to the main cabinet 100.

Opposite to this, when the water supply tank 61 serves a function of the water drain tank, the water drain tank may receive the water drained from the elements mounted to the cabinets. For an example, the water drain tank may collect condensed water formed by the steam generated at the water supply unit 30, or the water, not used, but held, in the water supply unit 30.

Since the cloth treating apparatus of the present invention has not one, but a plurality of the cabinets, with a plurality of housing spaces, it is required to supply or drain an amount of water larger than an amount of water used or formed from one cabinet. Therefore, a shape of the water supply tank used in the related art may cause a problem of shortage of a capacity.

In order to solve the problem, if a size of the water supply tank 61 of one cabinet selected from the plurality of cabinets, i.e., the main cabinet 100, is increased, a size of the first housing space 12 is reduced accordingly, to cause a problem in that an amount of the cloth housed and treated in the first housing space 12 is reduced.

In the embodiment of the present invention, both the main cabinet 100 and the supplementary cabinet 1000 have the water supply tanks 61, and 1061 respectively mounted thereto for using some of the water supply tanks 61 and 1061 as the water supply tanks for supplying the water, and rest of the water supply tanks 61 and 1061 are used as the water drain tanks for draining the water.

While the user may preset whether the water supply tanks 61 and 1061 are used as the water supply tanks or the water drain tanks when the cloth treating apparatus is fabricated, it is also possible that the user is made to be able to set such functions with the display unit 18. However, in a case the user is made to set with the display unit 18, it is required that the water supply tanks 61 and 1061 are made to perform functions changed and set thus as the valves and the like on related pipelines are manipulated, altogether.

In the meantime, it is preferable that, if a number of the cabinets to which the embodiment is applicable are even numbered, an half of the number of the water supply tanks 61 and 1061 in the cabinets are used as the water supply tanks, and the other half of the water supply tanks 61 and 1061 in the cabinets are used as the water drain tanks. Different from this, if an amount of the water required for the water supply tanks is larger, it is possible to provide a number of the water supply tanks larger than a number of the water drain tanks.

Opposite to this, it is possible that, if a number of the cabinets to which the embodiment is applicable are odd numbered, some of the water supply tanks 61 and 1061 in the cabinets are used as the water supply tanks, and rest of the water supply tanks 61 and 1061 in the cabinets are used as the water drain tanks. In this case, the number of the water supply tanks may be larger than the number of the water drain tanks by one, or vice versa.

In the meantime, it is possible that, if the number of the cabinets are odd numbered, while an half of the water supply tanks 61 and 1061 excluding one may be used as the water supply tank and the other half of the water supply tanks 61 and 1061 may be used as the water drain tank, a remained one of the water supply tanks 61 and 1061 is made to be able to changeover between water supply and water drain.

In the meantime, it is also possible to provide a water level sensor to each of the water supply tanks 61 and 1061 for determining an amount of the water held therein. According to the water level measured by the water level sensor, the control unit 2 may inform the user of whether the water is supplemented or drained from respective water supply tanks 61 and 1061 or not.

Figure 25:
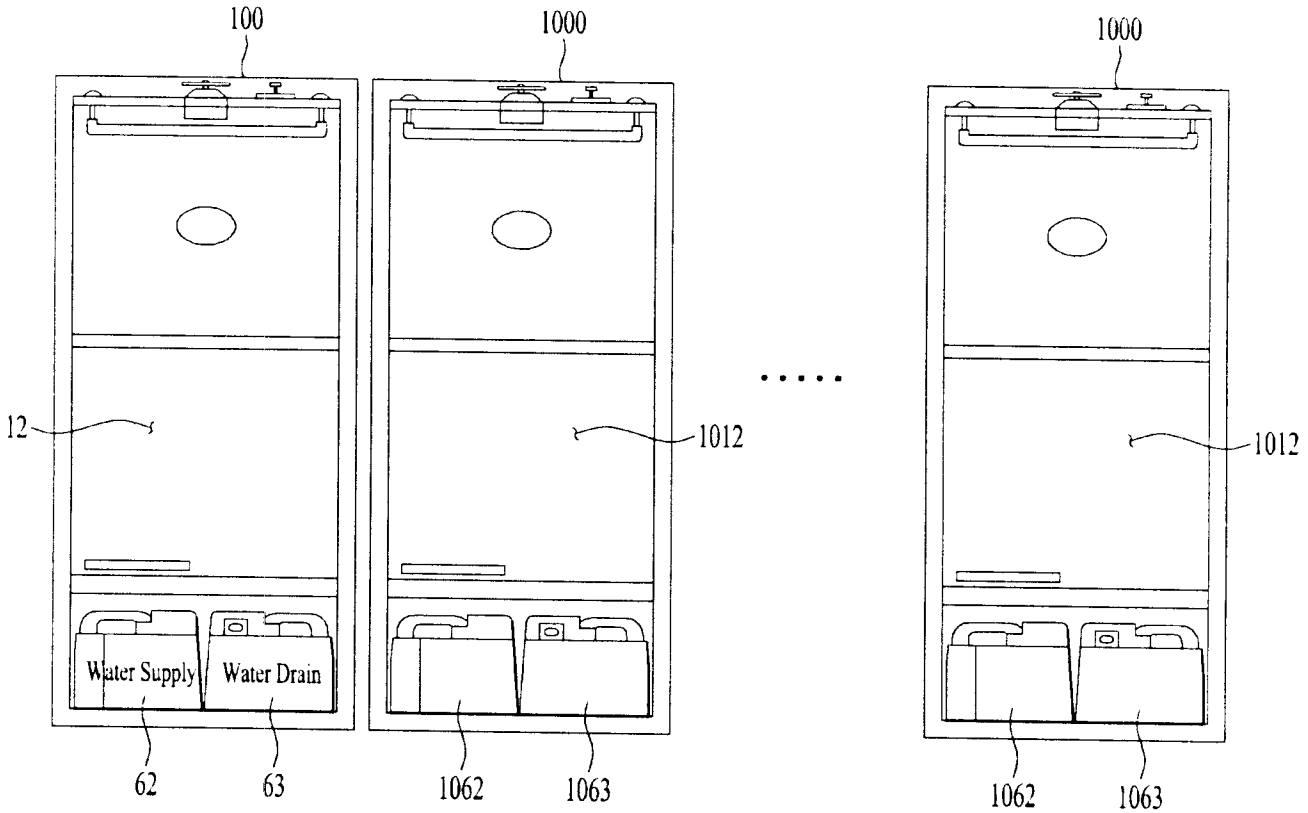
FIG. 25 illustrates a conceptual drawing of a cloth treating apparatus in accordance with another preferred embodiment of the present invention.

FIG. 25 illustrates a conceptual drawing of a cloth treating apparatus in accordance with another preferred embodiment of the present invention.

Different from FIG. 24, FIG. 25 illustrates a cloth treating apparatus including two water supply tanks mounted to each of the cabinets. Of course, the water supply tank in FIG. 25 has a size smaller than a size of the water supply tank used in FIG. 24.

That is, the main cabinet 100 may also have a water supply tank 62 for supplying the water, and a water drain tank 63 for draining the water, and the supplementary cabinet 1000 may also have a water supply tank 1062 for supplying the water, and a water drain tank 1063 for draining the water.

The water supply tanks 62 and 1062 and the water drain tanks 63 and 1063 may be configurations for water supply and water drain to/from the main cabinet 100 and the supplementary cabinet 1000, respectively. However, the water supply tanks 62 and 1062 are in communication with each other, such that, if one of the water supply tanks 63 and 1063 has shortage of the water, the water held in the other one of the water supply tanks 63 and 1063 can be used.

For this, it is also possible to provide pumps for forming a pressure for making smooth water supply to or drain from the cabinets, respectively. Of course, besides the pressure formed by the pump artificially, it is also possible to make the water to move through a connection between the water supply tanks 62 and 1062 or between the water drain tanks 63 and 1062 by using a pressure naturally formed by a head.

In the meantime, it is also possible that a water level sensor is mounted to each of the water supply tank 62 and 1062 and the water drain tank 63 and 1063 for determining an amount of the water held in each of the water supply tank 62 and 1062 and the water drain tank 63 and 1063. According to the water level measured by the water level sensor, the control unit 2 may inform the user of whether the water is supplemented to respective water supply tanks 62 and 1062 or not or drained from respective water drain tanks 63 and 1063 or not.

Figure 26:
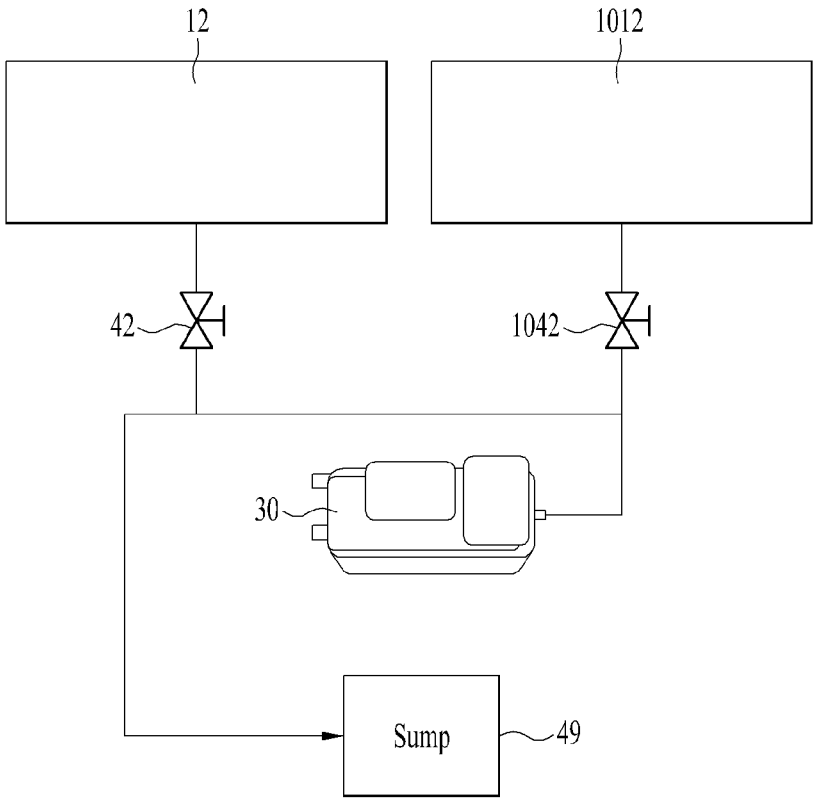
FIG. 26 illustrates a conceptual drawing for describing a spray system of a water spray unit.
Figure 27:
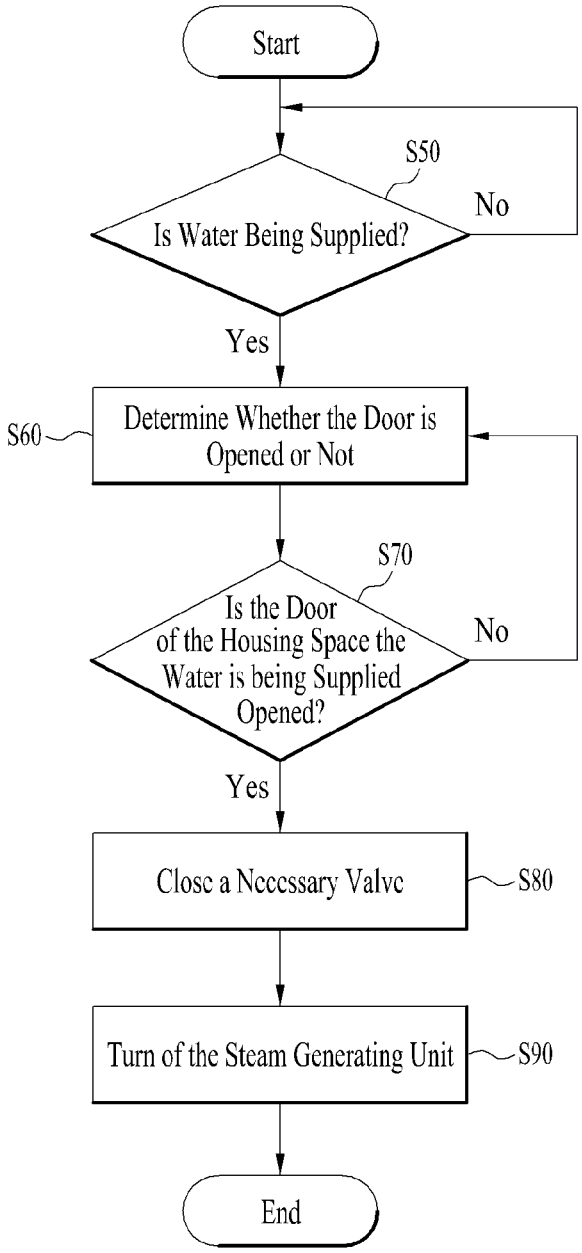
FIG. 27 illustrates a flow chart showing the steps of a method for controlling the water spray unit in FIG. 26.

FIG. 26 illustrates a conceptual drawing for describing a spray system of a water spray unit, and FIG. 27 illustrates a flow chart showing the steps of a method for controlling the water spray unit in FIG. 26.

FIG. 26 illustrates the first housing space 12 of the main cabinet 100, the second housing space 1012 of the supplementary cabinet 1000, and valves 42 and 1042 mounted to the flow passages to the housing spaces, respectively.

And, the valves 42 and 1042 have the water supply unit 30 connected thereto such that the water or the steam can be supplied from the water supply unit 30 to respective housing spaces depending on opening/closing of the valves 42 and 1042.

In the meantime, respective valves 42 and 1042 have the sump 49 connected thereto for making the condensed water formed in the flow passages through which the water or the steam is supplied to move to the sump 49. It is possible that the sump, an element mounted to the main cabinet 100, performs a function similar to the water supply tank, i.e., more specifically, the water drain tank.

By utilizing the embodiment shown in FIG. 26, the present invention can prevent the steam from supplying to the housing space of the cabinet if a door on the cabinet is opened. In general, since the steam supplied from the water supply unit 30 has a high temperature, if the steam is supplied continuously regardless of a situation in which the user opens the door, the user is liable to surprise or wounded seriously, such as burn. Therefore, it is preferable that, if the door on the cabinet is opened, it is made that the steam is not supplied to the space.

A method for controlling steam supply depending on door opening/closing will be described, with reference to FIG. 27.

At first, it is determined whether the steam is being supplied or not (S50). This is because, limiting to a case the water or the steam is being supplied to the first housing space 12 or the second housing space 1012, it is required that the water or the steam is not to be exposed to the user.

If it is determined that the water is being supplied, it is determined whether respective cabinet doors are opened or not (S60). The cloth treating apparatus of the present invention has a plurality of cabinets, and the door is mounted to each of the cabinets for enclosing each of the housing spaces. A physical contact sensor or an optical sensor may be used for determining whether the doors are opened or not. If the physical contact sensor is used, a nature of making a current to flow depending on closure of the door may be utilized.

A variety of sensors provided to the cabinets may transmit information to the control unit 2 through the supplementary communication unit 1002 and the main communication unit 3, and the control unit 2 may make necessary control.

Then, it is determined whether the door which closes the housing space the water or the steam is being supplied thereto is opened or not (S70). If the door which closes the housing space the water or the steam is being supplied thereto is opened, it is liable that the user is exposed to the water or the steam.

If the door which closes the housing space the water or the steam is being supplied thereto is opened, the valve closes the flow passage which supplies the steam or the water to the housing space. That is, since supply of the steam or the water through the flow passage is blocked, the water or the steam is not supplied to the housing space the door of which is opened.

Then, the water supply unit 30 is turned off (S90). If the water supply unit 30 is driven, the steam or the water is kept supplied. If the valve is closed, the steam or the water is compressed in the flow passage to build up a pressure therein. Therefore, it is desirable to turn off the water supply unit 30.

In the embodiment of the present invention, since it is liable that the heater at the water supply unit 30 is overloaded if the steam is supplied to the plurality of housing spaces at the same time, the cloth treating apparatus of the present invention is configured such that only one valve in communication with one of the housing spaces is opened, to supply the steam only to the one of the housing spaces. However, if the water supply unit 30 with a large capacity is used, it is also possible to make a plurality of the valves to open the flow passages to supply the steam to the plurality of the housing spaces.

In this case, it is possible to block only the flow passages of the valves which supply the steam to the housing spaces of which doors are opened, and to keep leave open the valves of the flow passages which supply the steam to the housing spaces of which doors are closed. Since all of the flow passages are not blocked, it is advantageous in that turning off of the water supply unit 30 is not required.

Such control for the water supply unit 30 may be applicable to the air supply unit 22 in the same fashion, too. For an example, if the door of the housing space the heated air is being supplied thereto is opened, the user is liable to be wounded by the heated air.

Therefore, the control unit 2 determines whether the door of the housing space the heated air is being supplied thereto is opened or not. If the door of the housing space the heated air is being supplied thereto is opened, the valve mounted to the flow passage is operated to block the flow passage which is supplying the heated air.

Different from the water supply unit 30, since the air supply unit 22 can supply the air or the heated air to the plurality of housing spaces at the same time, it is preferable that, if only one door of the plurality of housing spaces the heated air is being supplied thereto is opened, the air supply unit 22 is not turned off. This is because it is required that the air supply unit 22 keeps supplying the heated air to other housing spaces of which doors are not opened.

Of course, in a state the heated air is supplied to only one housing space, if the door of the housing space is opened, it may be possible to block the flow passage with the valve and turn off the air supply unit 22.

Alikely, if all of the plurality of doors of the housing spaces the heated air is being supplied thereto are opened, all of the flow passages which supply the heated air to the housing spaces are blocked, and the air supply unit 22 is turned off. If the air supply unit 22 is driven in a state the valves block entire flow passages, an inside pressure of the pipeline is liable to build up, excessively.

Figure 28:
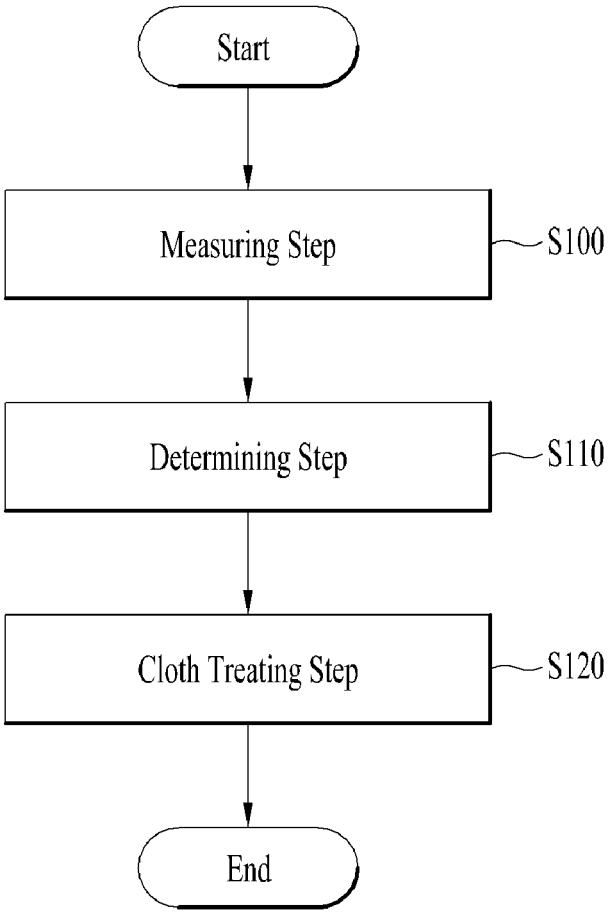
FIG. 28 illustrates a flow chart showing the steps of a method for controlling a cloth treating apparatus in accordance with a preferred embodiment of the present invention.

FIG. 28 illustrates a flow chart showing the steps of a method for controlling a cloth treating apparatus in accordance with a preferred embodiment of the present invention.

As described before, the cloth treating apparatus of the present invention has one control unit 2 provided to the main cabinet 100, and other supplementary cabinet 1000 may be controlled by the control unit 2. Therefore, the control unit 2 is required to allocate recourses such that limited resources are utilized for treating the cloths in respective housing spaces as fast as possible.

Therefore, the embodiment will describe an example of setting priorities for treating respective housing spaces with reference to a rate of the steam to be used.

Since only one water supply unit 30 can generate the steam which can be supplied to the housing spaces, it is difficult to supply the steam to the plurality of housing spaces at the same time. Though the steam is generated by a large capacity heater for supplying the steam to the plurality of housing spaces, there is a problem in that wattage which can be used by a general house is limited. Therefore, rather than increasing the capacity of the heater, it is required to control a steam supply rate.

At first, after sorting and placing a variety of forms of the cloths in respective housing spaces, the user closes the housing spaces with the doors, respectively. In this case, it is possible to place similar cloths in one housing space for treating the cloths in the same fashion. Of course, other forms of the cloths may be placed in other housing spaces, respectively.

Then, the user inputs desired menus for treating the cloths placed in respective housing spaces, respectively. There are different applicable menus, such as sanitization, refresh, and so on.

After the user's input is finished, a measuring step (S100) is performed, in which the steam rate to be used for the first housing space 12, and the steam rate to be used for the second housing space 1012 are measured according to the menus inputted by the user. In this case, the second housing space 1012 may be plural, the same as a number of the supplementary cabinets 1000. That is, if the number of the second housing space 1012 is two, the control unit 2 compares three values of the steam rate to be used for the first housing space 12, and the steam rates to be used for the two second housing spaces 1012 to one another.

After determining the steam rates, the control unit 2 determines the treatment priorities of the cloths housed in the housing spaces (S110).

For an example, it is possible to give a top priority to the cloth in the cabinet which requires a relatively high steam rate. For an example, if sanitization is set to the first housing space 12, and drying is set to the second housing space 1012, since sanitization of the cloth requires the steam rate higher than the drying of the cloth, at first the steam is supplied to the first housing space 12 which performs sanitization to treat the cloth. Then, after the steam is supplied to the first housing space 12 adequately, the steam is supplied to the second housing space 1012, to perform the drying.

In general, cloth treatment which requires a high steam supply rate requires a relatively long time period for performing the cloth treatment. Accordingly, by performing the menu which requires a long cloth treating time period on the whole at first, a time period required for the cloth treatment can be reduced, on the whole.

Opposite to this, different from the determining step S110, it is possible to give the top priority to the cloth in the cabinet which requires a relatively small steam rate.

For an example, it is possible to set sanitization to the first housing space 12, and drying to the second housing space 1012. In general, sanitization of the cloth requires a steam rate higher than the steam rate required for drying the cloth. Therefore, in this case, the cloth treatment may be performed by supplying the steam to the second housing space 1012 which drying the cloth at first. In general, if the menu requires a small rate of the steam, a relatively short time period is required for performing the cloth treatment of the menu. Accordingly, this case is advantageous in that fast cloth treatment can be performed for the cloth housed in the housing space by treating the menu which requires the short time period at first.

Then, a cloth treating step S120 is performed, for treating the cloths according to the priorities set thus. If the cloth treatment of the housing spaces is finished, the user opens the doors which close the housing spaces selectively, and takes the cloths out of the housing spaces.

Of course, it is also possible to set the priority by using a rate of use of the air supply unit 22 which supplies the air or the heated air in the determining step S110 in which the priority of the cloth treatment is determined. However, since power consumption does not increase much compared to an ordinary time even if the air supply unit 22 supplies the heated air or the air to the plurality of housing spaces at the same time, the power consumption can hardly be a limitation factor in setting the priority compared to the water supply unit 30. That is, the air supply unit 22 can supply the heated air or the air to the plurality of housing spaces at the same time according to the menus of user's selection.

Figure 29:
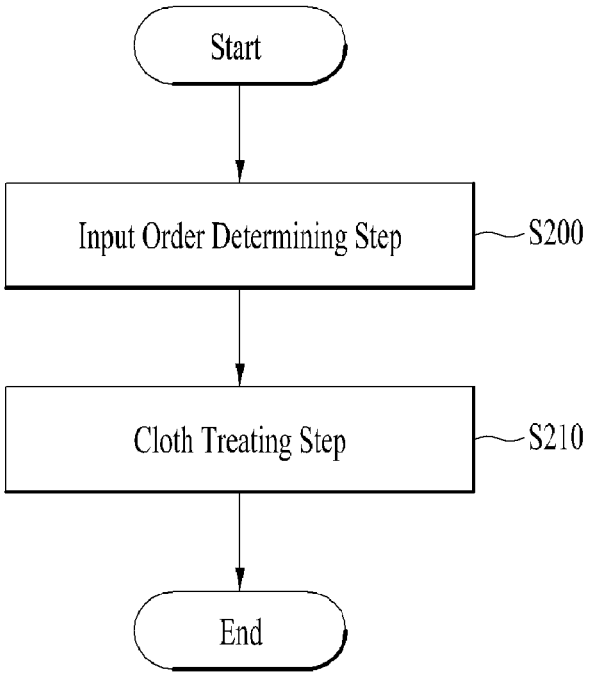
FIG. 29 illustrates a flow chart showing the steps of a method for controlling a cloth treating apparatus in accordance with another preferred embodiment of the present invention.

FIG. 29 illustrates a flow chart showing the steps of a method for controlling a cloth treating apparatus in accordance with another preferred embodiment of the present invention.

Referring to FIG. 29, different from the embodiment described with reference to FIG. 28, the embodiment suggests varying the treatment priority of the cloths housed in respective housing spaces with an order of user's menu input.

At first, the user opens the plurality of cabinet doors, sorts the cloths according to modes of treatments, and houses the cloths in respective housing spaces according to the sorting. Then, the user closes the doors, and selects cloths treatment menus the user desires for respective housing spaces with the display unit 18.

The control unit 2 determines an order of the menus the user inputs (S200). For an example, it is possible that the user inputs the drying as the menu to be treated at the second housing space 1012 at first, and inputs the sanitization as the menu to be treated at the first housing space 12. In this case, different from the embodiment described before, it is possible to start treatment of the cloth housed in the second housing space 1012 at first and to treat the cloth housed in the first housing space 12 at a next time, regardless of the steam rate to be used in the sanitization and the drying.

In general, the user may recognize that it is preferable that the cloth treating is performed according to an input order of commands for the first and second housing spaces, the commands inputted by the user. This is because the user is liable to think that the menu inputted at first is transmitted to the control unit and performed at first.

Opposite to this, if the user inputs the menu intended to treat at the first housing space 12 before the menu intended to treat at the second housing space 1012, it is possible to perform the cloth treatment for the first housing space 12, at first.

In the meantime, the user may desire sanitization at the first housing space 12 and at the second housing space 1012, too. In this case, in a case of the embodiment described before, it is difficult to set the priority of the cloth treating. This is because the same cloth treating menus are selected for the two housing spaces, and the same steam rates are required.

Therefore, like another embodiment of the present invention, in this case, it is preferable that the order of the cloth treating is determined according to the input order by the user. That is, after the user selects the sanitization menu for the first housing space 12, if the user selects the sanitization menu for the second housing space 1012, the cloth treatment for the first housing space 12 has a first priority. Opposite to this, after the user selects the sanitization menu for the second housing space 1012, if the user selects the sanitization menu for the first housing space 12, the cloth treatment for the second housing space 1012 has the first priority.

Since the embodiment of the present invention can mount the display unit 18 only to the main cabinet 100 for inputting the menu, a problem that the same menus are inputted at the same time does not takes place. In a variation of the embodiment of the present invention, in a type of the cloth treating apparatus having a plurality of the display units 18 provided to the plurality of cabinets respectively, the user may input the menus desired to treat at respective housing spaces of the cabinets. However, even in this case too, since it is almost impossible to input the menus for the plurality of housing spaces at the same time, a problem related to above will not take place.

FIGS. 30 to 33 illustrate timing charts each showing a method for controlling a cloth treating apparatus in accordance with another preferred embodiment of the present invention. Respective examples describe a cloth treating process for the housing spaces in a state the priorities of the treatment are set already for respective housing spaces, in detail.

Figure 30:
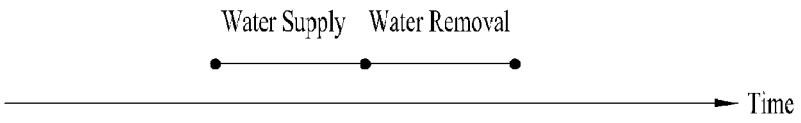
FIGS. 30 to 33 illustrate timing charts each showing a method for controlling a cloth treating apparatus in accordance with another preferred embodiment of the present invention.

FIG. 30 illustrates a process for performing cloth treatment for one housing space. In general, if the cloth is housed only in the first housing space 12 of the main cabinet 100, steps as shown in FIG. 30 may be performed. In FIG. 30, the water is supplied to the cloth by the water supply unit 30, and the water may be removed from the cloth by the air supply unit 22.

Of course, different from FIG. 30, the water removal may be performed at first, and, then, the water supply may be performed. Such treatment is for preventing static electricity from taking place, which is liable to take place at the cloth or for removing a hazard of wound to the user due to the housing space maintained at a high temperature as the steam is sprayed to the cloth by the water supply unit 30 after the heated air is supplied to the cloth by air supply unit 22 during the water removal is performed.

Figure 31:
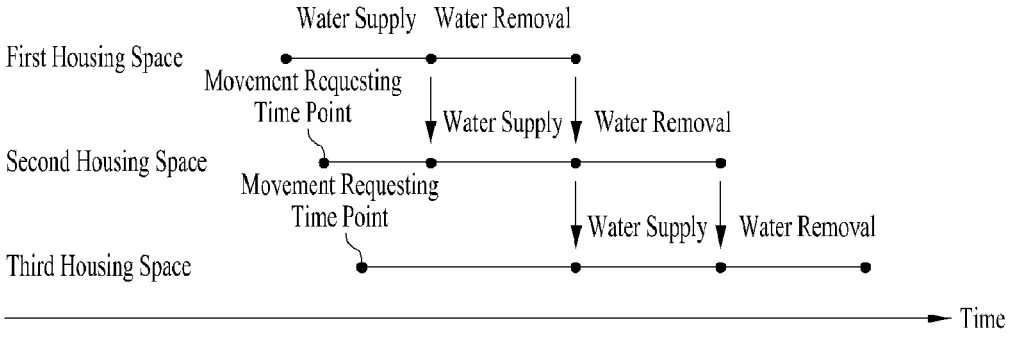

FIG. 31 illustrates a diagram of a control flow on one first housing space 12 provided to the main cabinet 100, and two second housing spaces 1012 provided to two supplementary cabinets 1000, respectively. There are three housing spaces in total including one first housing space 12 and two second housing spaces 1012. In FIG. 31, the cloth housed in the first housing space 12 is treated at first, and the cloth housed in the second housing space shown just under the first housing space 12 is treated for the second time, and the cloth housed in the second housing space shown just under the second housing space is treated for the third time.

If more supplementary cabinets are provided to the cloth treating apparatus to have three or more than three second housing spaces, additional control may be performed according to methods described below with reference to respective drawings.

Referring to FIG. 31, by making a water supply time point and a water removing time point for one first housing space 12 and two second housing spaces 1012 to coincide to one another, an entire resource allocation in view of time can be made, efficiently.

A process is performed, in which the water is supplied to the cloth housed in the first housing space 12 at first, and then, the water is removed from the cloth housed in the first housing space 12.

In this case, at the time point the water supply to the first housing space 12 ends, the water supply to the second housing space 1012 starts. That is, taking a limited resource of the water supply unit 30 into account, the water is supplied to the first housing space 12 at first, and then, after the water supply to the first housing space 12 ends, the water supply to the second housing space 1012 starts.

Particularly, the water removal from the first housing space 12 and the water supply to the second housing space 1012 are made to be started at the same time. In general, since the water removal is made by using the air supply unit 22, and the water supply is made by using water supply unit 30, enabling to use different resources at the same time, entire required time period can be reduced shorter than arranging entire cloth treating process on a line.

At the time point the water removal from the first housing space 12 ends, treatment of the cloth housed in the first housing space 12 may be completed. Therefore, upon finishing the water removal from the first housing space 12, the user may take the cloth out of the first housing space 12.

And, at the time point the water supply to one of the second housing spaces 1012 ends, the water supply to the other one of the second housing spaces 1012 starts. As the water supply to the one of the second housing spaces 1012 ends, though the water supply unit 30 may be turned off, since the water supply to the other one of the second housing spaces 1012 is undergoing, a state in which the water supply unit 30 is turned off does not take place.

Alikely, at the time point the water supply to the one of the second housing spaces 1012 ends, the water removal from the one of the second housing spaces 1012 starts. While the water is being removed from the one of the second housing spaces 1012, at the same time with this, the water is being supplied to the other one of the second housing spaces 1012.

Then, if the water removal from the one of the second housing spaces 1012 ends, to finish treatment of the cloth housed in the one of the second housing spaces 1012, the user may take the cloth out of the one of the second housing spaces 1012.

Upon finishing the cloth treatment for the one of the second housing spaces 1012, the cloth treatment is performed for the other one of the second housing spaces 1012, and if the water removal from the other one of the second housing spaces 1012 is finished, the cloth treatment housed in the three housing spaces may be completed.

Figure 32:
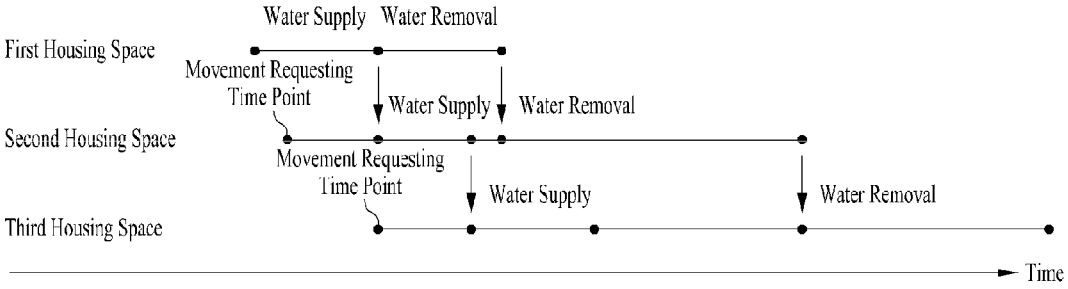

Alike the embodiment shown in FIG. 31, the embodiment shown in FIG. 32 illustrates a control flow for three housing spaces of one first housing space 12 and two second housing spaces 1012.

A time period required for treating the cloths with the water supply or the water removal for respective housing spaces may vary with the menus the user inputs. Therefore, in FIG. 32, entire cloth treatment may be performed with reference to operation of the water supply unit 30 and the air supply unit 22 in view of water supply. That is, the control flow is applicable to a configuration in which both the water supply unit 30 and the air supply unit 22 are made to be able to treat only one housing space.

The water is supplied to the cloth housed in the first housing space 12, at first. Then, in succession to the water supply, the water is removed from the cloth housed in the first housing space 12.

At the time point the water supply to the first housing space 12 ends, the water supply to the second housing space 1012 starts. This is because the water supply performed by the water supply unit 30 of a limited resource requires resource allocation in view of time as described in this embodiment.

Since the water removal for the first housing space 12 can be performed regardless of the cloth treatment for the second housing spaces 1012, the cloth treatment for the first housing space 12 and the second housing space 1012 are performed at the same time.

After finishing the water supply to the second housing space 1012, it is required to remove the water from the second housing space 1012. However, since the first housing space 12 is at a stage of water removal still, no water removal is performed for the second housing space 1012.

In the meantime, at the time point the water supply to one of the second housing spaces 1012 ends, the water supply to the other one of the second housing spaces 1012 starts. Since the water supply unit 30 which supplies the water in not used, not only by the first housing space, but also by the one of the second housing spaces 1012, the other one of the second housing spaces 1012 may use the water supply unit 30.

After the water removal from the first housing space 12 is finished, the water removal for the one of the second housing spaces 1012 starts. That is, there is a predetermined time gap between finishing of the water supply to the one of the second housing spaces 1012 and starting of the water removal from the one of the second housing spaces 1012.

At an instant the water supply to the one of the second housing spaces 1012 ends, the water supply to the other one of the second housing spaces 1012 starts. Since the water removal from the one of the second housing spaces 1012 is continuous even after the water supply to the other one of second housing spaces 1012 ends, it is required that the water removal from the one of the second housing spaces 1012 ends for performing the water removal from the other one of the second housing spaces 1012. Therefore, alike the one of the second housing spaces 1012, the water removal from the other one of the second housing spaces 1012 can not start until a predetermined time period is passed after the water supply to the other one of the second housing spaces 1012 ends.

Upon finishing the water removal for respective second housing spaces 1012, finishing the cloth treatment for the second housing spaces 1012, the user may take the cloths out of the second housing spaces 1012, or stores the cloths in the second housing spaces 1012.

Figure 33:
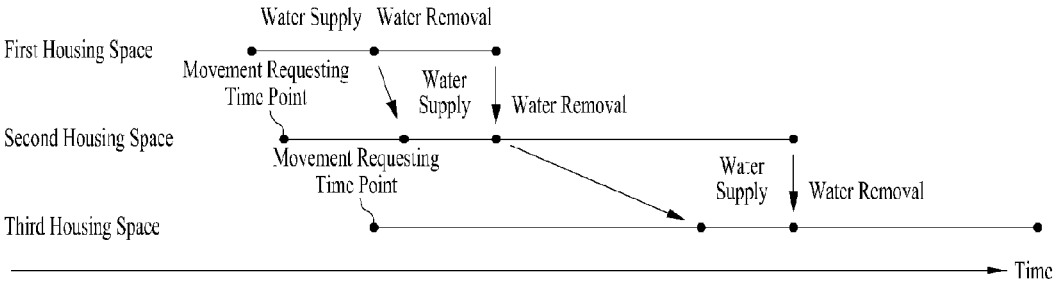
Figure 34:
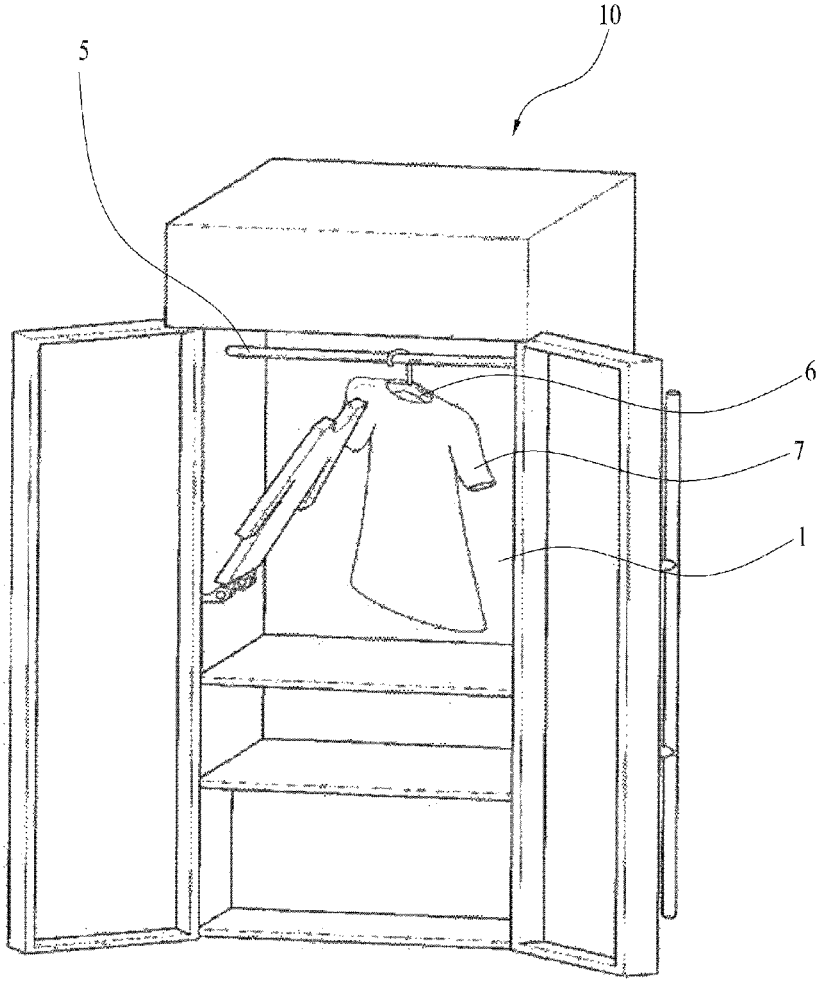
Fig. 34 (Prior Art)
FIG. 34 illustrates a perspective view of a related art cloth treating apparatus.

A mode of the embodiment illustrated in FIG. 33 shows performing a cloth treatment process, not taking the water supply unit 30 which supplies the water into account at first, but taking the air supply unit 22 which removes the water into account at first.

If a predetermined time period is passed in a state the cloth contains the water due to the water supplied to the cloth in the cloth treatment process, a problem may take place, in that the water is not removed from the cloth, easily. Therefore, it is preferable that the water removal is performed right after the water supply to the cloth. Such control is a cloth treatment process control performed for respective housing spaces based on cloth treatment efficiency, such as a water removal effect of the cloth, and the like.

At first, the water is supplied to the first housing space 12, and right after the water supply ends, the water removal from the first housing space 12 may be made.

The water supply to the second housing spaces 1012 does not starts at the time point the water supply to the first housing space 12 ends, but the water supply to the second housing space 1012 does not start until a predetermined time period is passed after the water removal from the first housing space 12 starts.

In this case, the starting time point for the water supply to the second housing space 1012 can be calculated by subtracting a time period required for supplying the water to the second housing space 1012 from a time point when the water removal from the second housing space 1012 can start as the water removal from the first housing space 12 ends. For an example, if it is scheduled to finish the water removal from the first housing space 12 at 10 A.M., and the time period required for supplying the water to the second housing space 1012 is 10 minutes, it is preferable that the time point the water supply to the second housing space 1012 starts is 9:50 A.M.

This is because treating the cloth housed in the second housing space is easy only if the water removal is performed right after the water supply to the second housing space 1012 ends. Opposite to this, the water removal from the first housing space 12 may be performed regardless of the treatment process for the second housing space 1012.

In the meantime, even if the water supply to the one of the second housing spaces 1012 ends, the water supply to the other one of the second housing spaces 1012 dose not starts. This is because the other one of the second housing spaces 1012 is also required to have the water supply thereto, and the water removal therefrom right after the water supply ends.

That is, even if the cloth treatment for the first housing space 12 is finished as the water removal from the first housing space 12 ends, and the water removal from the one of the second housing spaces 1012 ends, the water supply to the other one of the second housing spaces 1012 does not start at once.

For an example, if the water removal from the one of the second housing spaces 1012 is scheduled to finish at 11:00 A.M., and a time period required for supplying the water to the other one of the second housing spaces 1012 is 10 minutes, it is preferable that a time point the water is supplied to the other one of the second housing spaces 1012 is at 10:50 A.M. That is, the time point the water is supplied to the other one of the second housing spaces 1012 starts taking the time point the water supply to the one of the second housing spaces 1012 ends, and the time point the water removal from the other one of the second housing spaces 1012 starts into account.

In general, in comparison to the mode of the embodiment described with reference to FIG. 32, the mode of the embodiment described with reference to FIG. 33 may take a longer time period. However, since the treatment in FIG. 33 performs the water removal right after the time point the water supply ends, effective cloth treatment can be made available.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a cloth treating apparatus, including a main cabinet having a first housing space for housing cloth therein and a water spray unit for supplying steam to the first housing space, at least one supplementary cabinet having a second housing space for housing the cloth therein, and a control unit for controlling the water supply unit to supply the steam to the first housing space or the second housing space selectively, comprising:

a measuring step for measuring a steam rate to be used for the first housing space, and the steam rate to be used for the second housing space;

a determining step for setting priorities of cloth treatment according to a result of the measurement in the measuring step; and a cloth treating step for performing cloth treatment of the cloth with a first priority.

2. The method as claimed in claim 1, wherein the determining step includes the step of giving the first priority to the cloth in the cabinet which requires a higher steam rate than other cabinets.

3. The method as claimed in claim 1, wherein the determining step includes the step of giving the first priority to the cloth in the cabinet which requires a lower steam rate than other cabinets.

4. The method as claimed in claim 1, wherein the cloth treating step includes the step of supplying air or heated air both to the first housing space and the second housing space or either to the first housing space or to the second housing space.

5. A cloth treating apparatus comprising:

a main cabinet having a first housing space for housing cloth therein and a water spray unit for supplying steam to the first housing space;

at least one supplementary cabinet having a second housing space for housing the cloth therein; and a control unit for controlling the water supply unit to supply the steam to the first housing space or the second housing space, selectively, wherein the control unit determines cloth treatment priorities of the main cabinet and the supplementary cabinet by measuring steam rates of the first housing space or the second housing space required.

6. The cloth treating apparatus as claimed in claim 5, wherein the control unit is provided to the main cabinet.

7. The cloth treating apparatus as claimed in claim 5, wherein the main cabinet and the supplementary cabinet are installed adjacent to, or spaced from, each other.

8. The cloth treating apparatus as claimed in claim 7, wherein the control unit treats the cloth in the cabinet which requires the steam rate higher than the other cabinet, and then treats the cloth in the other cabinet.

9. The cloth treating apparatus as claimed in claim 7, wherein the control unit treats the cloth in the cabinet which requires the steam rate lower than the other cabinet, and then treats the cloth in the other cabinet.

10. The cloth treating apparatus as claimed in claim 5, wherein the main cabinet has an air supply unit provided thereto for supplying air or heated air to the first housing space, and the control unit controls the air supply unit to supply the air or the heated air both to the first housing space and the second housing space or either to the first housing space or to the second housing space.

11. The cloth treating apparatus as claimed in claim 10, wherein the air supply unit includes a heat pump having an evaporator, a compressor, and a condenser for circulating refrigerant therethrough.

12. The cloth treating apparatus as claimed in claim 5, further comprising a movable hanger for hanging the cloth therefrom and applying a predetermined movement to the cloth.

13. The cloth treating apparatus as claimed in claim 5, wherein two sets of the supplementary cabinet are provided, and the supplementary cabinets are arranged side by side on one side of the main cabinet.

14. The cloth treating apparatus as claimed in claim 5, wherein two sets of the supplementary cabinet are provided, and the supplementary cabinets are arranged on both sides of the main cabinet.

15. The cloth treating apparatus as claimed in claim 5, wherein the main cabinet has a display unit provided thereto for displaying information on the cloth treatment made at the first housing space and the second housing space.

16. The cloth treating apparatus as claimed in claim 5, wherein the main cabinet includes a main communication unit for communication with the control unit, and the supplementary cabinet includes a supplementary communication unit for communication with the main communication unit.

* * * * *